US008324990B2

(12) United States Patent
Vouloumanos

(10) Patent No.: US 8,324,990 B2
(45) Date of Patent: Dec. 4, 2012

(54) MULTI-COMPONENT WAVEGUIDE ASSEMBLY

(75) Inventor: Nick Vouloumanos, Westmount (CA)

(73) Assignee: Apollo Microwaves, Ltd., Dorval, Quebec (CA)

( * ) Notice: Subject to any disclaimer, the term of this patent is extended or adjusted under 35 U.S.C. 154(b) by 825 days.

(21) Appl. No.: 12/323,651

(22) Filed: Nov. 26, 2008

(65) Prior Publication Data

US 2010/0127804 A1 May 27, 2010

(51) Int. Cl.
*H01P 1/00* (2006.01)
*H01P 11/00* (2006.01)

(52) U.S. Cl. ..... 333/248; 333/1.1; 29/600

(58) Field of Classification Search ..... 333/1.1, 333/33–35, 248, 254, 255, 260, 24.1, 24.2; 29/600, 601, 830
See application file for complete search history.

(56) References Cited

U.S. PATENT DOCUMENTS

| | | | | |
|---|---|---|---|---|
| 3,866,150 | A | 2/1975 | Thai et al. | |
| 4,058,780 | A | 11/1977 | Riblet | |
| 4,069,456 | A * | 1/1978 | Bensussan et al. | 327/551 |
| 4,684,908 | A | 8/1987 | Kuntzmann et al. | |
| 4,697,158 | A | 9/1987 | Hoover et al. | |
| 4,701,728 | A * | 10/1987 | Igarashi | 333/212 |
| 4,801,902 | A * | 1/1989 | Hoover et al. | 333/1.1 |
| 5,469,022 | A * | 11/1995 | Begum et al. | 315/5.39 |
| 6,359,792 | B1 | 3/2002 | Genfan | |
| 6,407,646 | B1 | 6/2002 | Johnson | |
| 6,518,851 | B2 | 2/2003 | Kocharyan | |
| 6,710,678 | B2 * | 3/2004 | Thormar | 333/135 |
| 7,019,706 | B2 | 3/2006 | Yoneda et al. | |
| 7,176,767 | B2 | 2/2007 | Kroening | |
| 7,230,507 | B2 | 6/2007 | Kroening | |
| 7,242,263 | B2 | 7/2007 | Kroening | |
| 7,250,835 | B2 * | 7/2007 | Higgins et al. | 333/208 |
| 7,259,640 | B2 | 8/2007 | Brown et al. | |
| 7,280,011 | B2 * | 10/2007 | Bayar et al. | 333/248 |
| 7,332,982 | B2 | 2/2008 | Yun et al. | |
| 7,746,189 | B2 * | 6/2010 | Hocine et al. | 333/1.1 |
| 2006/0261909 | A1 | 11/2006 | Kroening | |

FOREIGN PATENT DOCUMENTS

JP 2007005955 A 1/2007

OTHER PUBLICATIONS

IEEE, Design and fabrication of a nonradiative dielectric waveguide circulator, Yoshinaga and Yoheyama, published Nov. 1988.
IEEE, WR75 Junction circulator using 90 degrees and 180 degrees ridge UEs, Helszajin, Tsounis and Caplin, Apr. 2002.

* cited by examiner

*Primary Examiner* — Dean O Takaoka
*Assistant Examiner* — Alan Wong

(57) ABSTRACT

A waveguide assembly comprising at least two waveguide components. The waveguide assembly comprising a first waveguide portion and a second waveguide portion each comprising an interior surface and an exterior surface. The interior surface of the first waveguide portion defining a first portion of a first microwave component and a first portion of a second microwave component. The interior surface of the second waveguide portion defining a second portion of the first microwave component and a second portion of the second microwave component. The first waveguide portion and the second waveguide portion being adapted for being coupled together to form the waveguide assembly such that, when coupled together, the waveguide assembly comprises at least the first microwave component and the second microwave component.

20 Claims, 19 Drawing Sheets

MULTI-COMPONENT WAVEGUIDE ASSEMBLY

FIELD OF THE INVENTION

The present invention relates to the field of passive microwave components, and more specifically to waveguide assemblies that comprise a first portion and a second portion that each defines a portion of multiple microwave components therein.

BACKGROUND OF THE INVENTION

Passive waveguide assemblies are known in the art for handling microwave signals. Such waveguide assemblies generally include multiple waveguide components, such as harmonic filters, circulators, isolators, transmit filters, coupling devices (power monitors) and arc guides, that are all connected together. Each of the waveguide components that is assembled to form the overall waveguide assembly is designed and manufactured as a separate physical component, such that in use, each component is coupled to an adjacent component in order to form the complete waveguide assembly.

In order to enable the waveguide components to be coupled together, each of the components is designed with flanges or connecting interfaces on either end. The flanges/interfaces of two consecutive components are then connected together via bolts or screws, so as to secure two consecutive waveguide components together. Unfortunately, a deficiency with connecting the components of a waveguide output assembly together is that the connection via the flanges results in a certain amount of RF leakage and increases the overall insertion loss of the assembly. RF leakage can cause undesirable interference with the signals being output from the waveguide assembly.

In addition, it is difficult to be able to predict how the individually connected waveguide components will interact with each other once they are all connected together to form the waveguide assembly. More specifically, once the individual waveguide components have been connected together, the performance characteristics of the overall waveguide assembly cannot be predicted with any accuracy. As a result, significant tuning is often required, using either dent tuning or tuning screws, once the waveguide components have been connected together.

In light of the above, there is a need in the industry for an improved waveguide output assembly that alleviates, at least in part, the deficiencies of existing waveguide output assemblies.

SUMMARY OF THE INVENTION

In accordance with a first broad aspect, the present invention provides a waveguide assembly comprising a first waveguide portion and a second waveguide portion. The first waveguide portion comprises an interior surface and an exterior surface. The interior surface defines a first portion of a first waveguide component and a first portion of a second waveguide component. The second waveguide portion comprises an interior surface and an exterior surface. The interior surface defines a second portion of the first waveguide component and a second portion of the second waveguide component. The first waveguide portion and the second waveguide portion are adapted for being coupled together to form the waveguide assembly such that, when coupled together, the waveguide assembly comprises at least the first waveguide component and the second waveguide component.

In accordance with a second broad aspect, the present invention provides a method that comprises manufacturing a first waveguide portion of a waveguide assembly, manufacturing a second waveguide portion of the waveguide assembly and coupling the first waveguide portion and the second waveguide portion together. The first waveguide portion comprises an exterior surface, and an interior surface that defines a first portion of a first waveguide component and a first portion of a second waveguide component. The second waveguide portion of the waveguide assembly comprises an exterior surface, and an interior surface that defines a second portion of the first waveguide component and a second portion of the second waveguide component. When the first waveguide portion and the second waveguide portion are coupled together, the interior surface of the first waveguide portion and the interior surface of the second waveguide portion together define the first waveguide component and the second waveguide component.

In accordance with a third broad aspect, the present invention provides a waveguide assembly that comprises a first waveguide portion and a second waveguide portion. The first waveguide portion defines a first portion of a first microwave component and a first portion of a second microwave component. The second waveguide portion defines a second portion of the first microwave component and a second portion of the second microwave component. The waveguide assembly further comprises a matching network defining a space between the first waveguide component and the second waveguide component.

In accordance with a third broad aspect, the present invention provides a method that comprises selecting a desired performance characteristic for a waveguide assembly. The waveguide assembly comprises a first waveguide component and a second waveguide component. The method further comprises determining, at least in part on the basis of the desired performance characteristic for the waveguide assembly, the dimensions of a matching network positioned between the first waveguide component and the second waveguide component.

Figure 1:
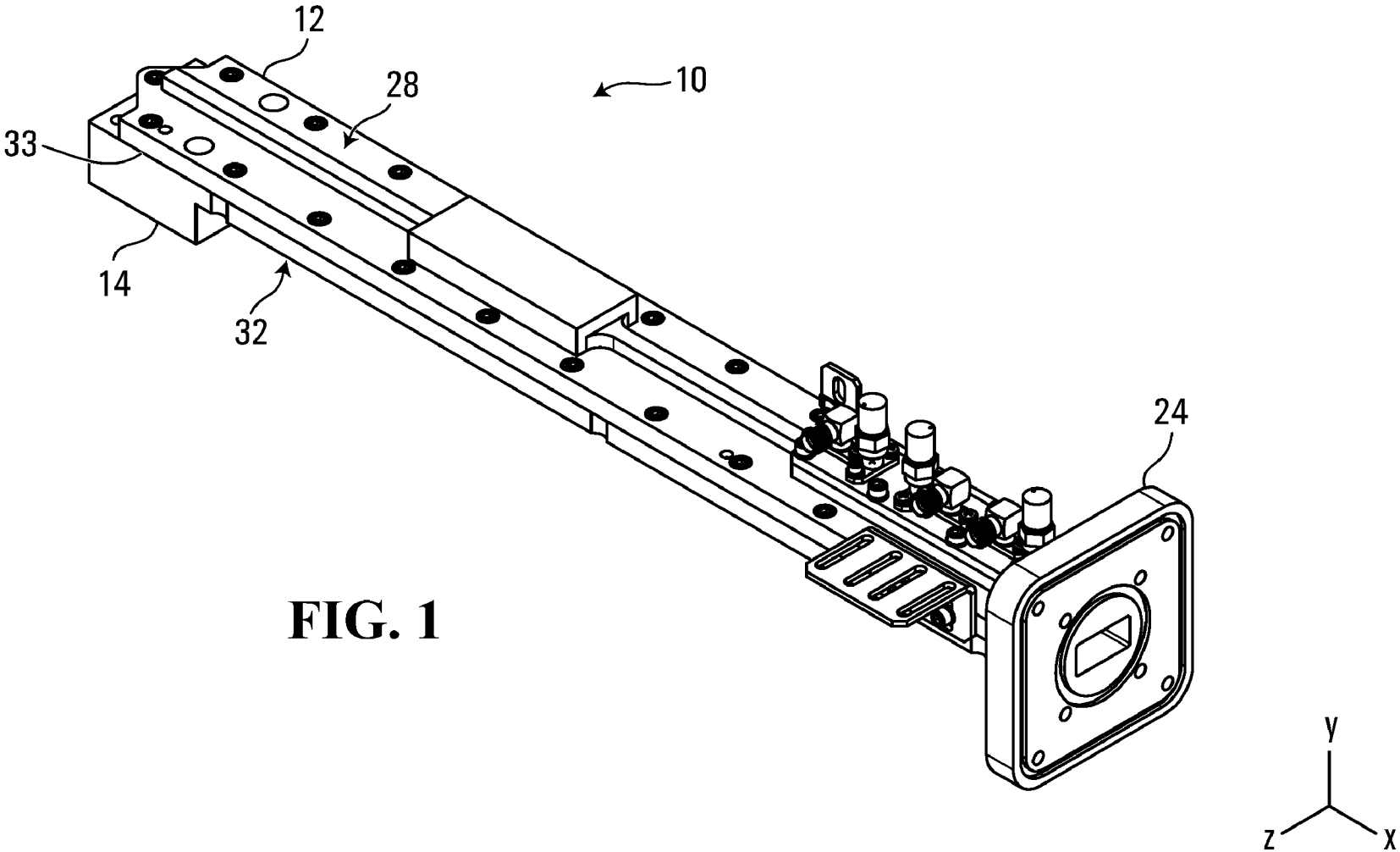
FIG. 1 shows a front perspective view of a waveguide assembly in accordance with a first non-limiting example of implementation of the present invention.

Other aspects and features of the present invention will become apparent to those ordinarily skilled in the art upon review of the following description of specific embodiments of the invention in conjunction with the accompanying figures.

DETAILED DESCRIPTION

The following specification will describe waveguide assemblies in accordance with the present invention with reference to three different examples of implementation; namely waveguide assembly 10 shown in FIGS. 1 through 7, waveguide assembly 40 shown in FIGS. 8 through 14 and waveguide assembly 80 shown in FIGS. 15 through 21.

As will be described in more detail below, each of the waveguide assemblies 10, 40 and 80 comprises a first portion and a second portion, wherein each of the first portion and the second portion defines a portion of multiple waveguide components. As such, when the first portion and the second portion are connected together, the complete waveguide assembly comprises the combination of at least two waveguide components that are integrated into a waveguide assembly made up of only two portions. Although only three examples of implementation are shown and described in the present specification and drawings, it should be appreciated that waveguide assemblies in accordance with the present invention can take on an infinite number of shapes and configurations.

Waveguide Assembly 10—First Non-Limiting Embodiment

Figure 2:
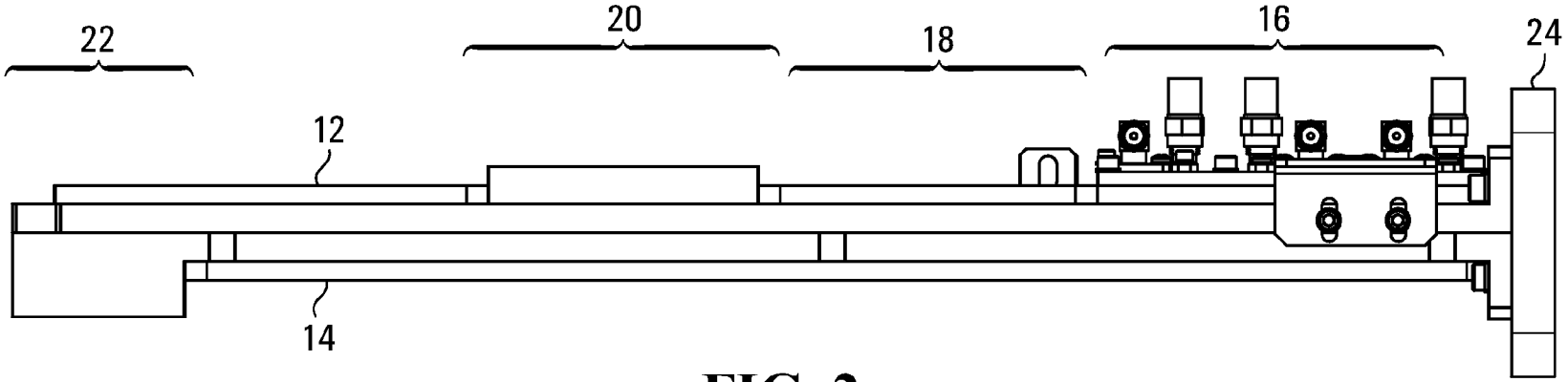
FIG. 2 shows a side plan view of the waveguide assembly of FIG. 1.
Figure 3:
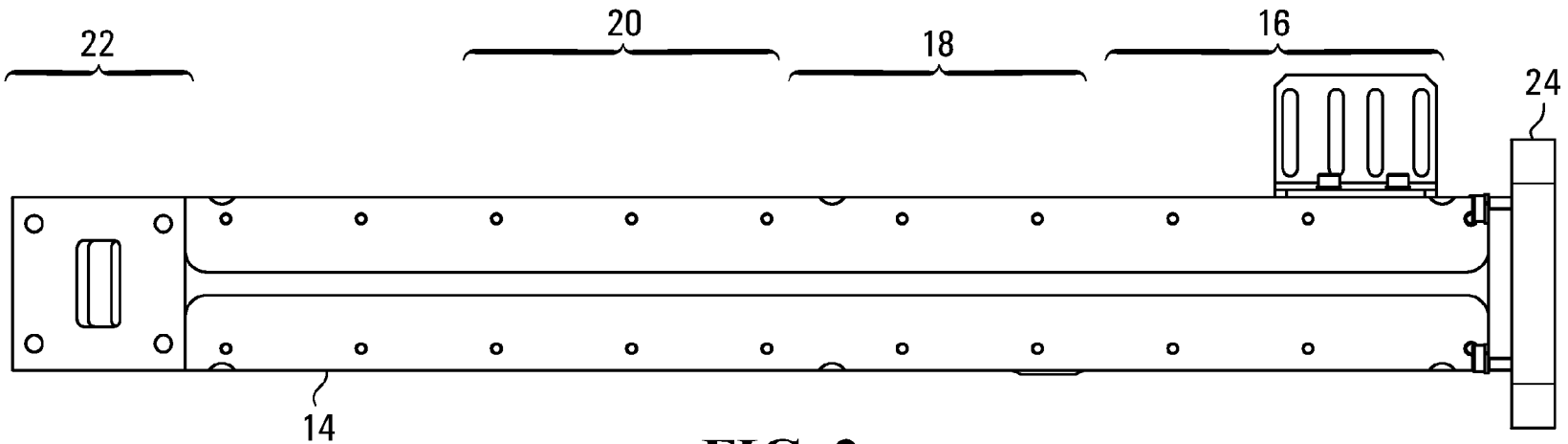
FIG. 3 shows a bottom plan view of the waveguide assembly of FIG. 1.

Shown in FIGS. 1, 2 and 3 is a waveguide assembly 10 in accordance with a first non-limiting example of implementation of the present invention. Waveguide assembly 10 comprises a first portion 12 and a second portion 14, that when connected together, form the complete waveguide assembly 10. The first portion 12 of the waveguide assembly 10 and the second portion 14 of the waveguide assembly 10 each define a portion of four separate waveguide components, which in the embodiment shown are a monitoring coupler 16, a harmonic filter 18, a transmit filter 20 and an e-bend 22 (which can also be referred to as an elbow). The functionality of each of these individual components is known in the field of microwave waveguides, and as such will not be described in more detail herein.

Figure 4:
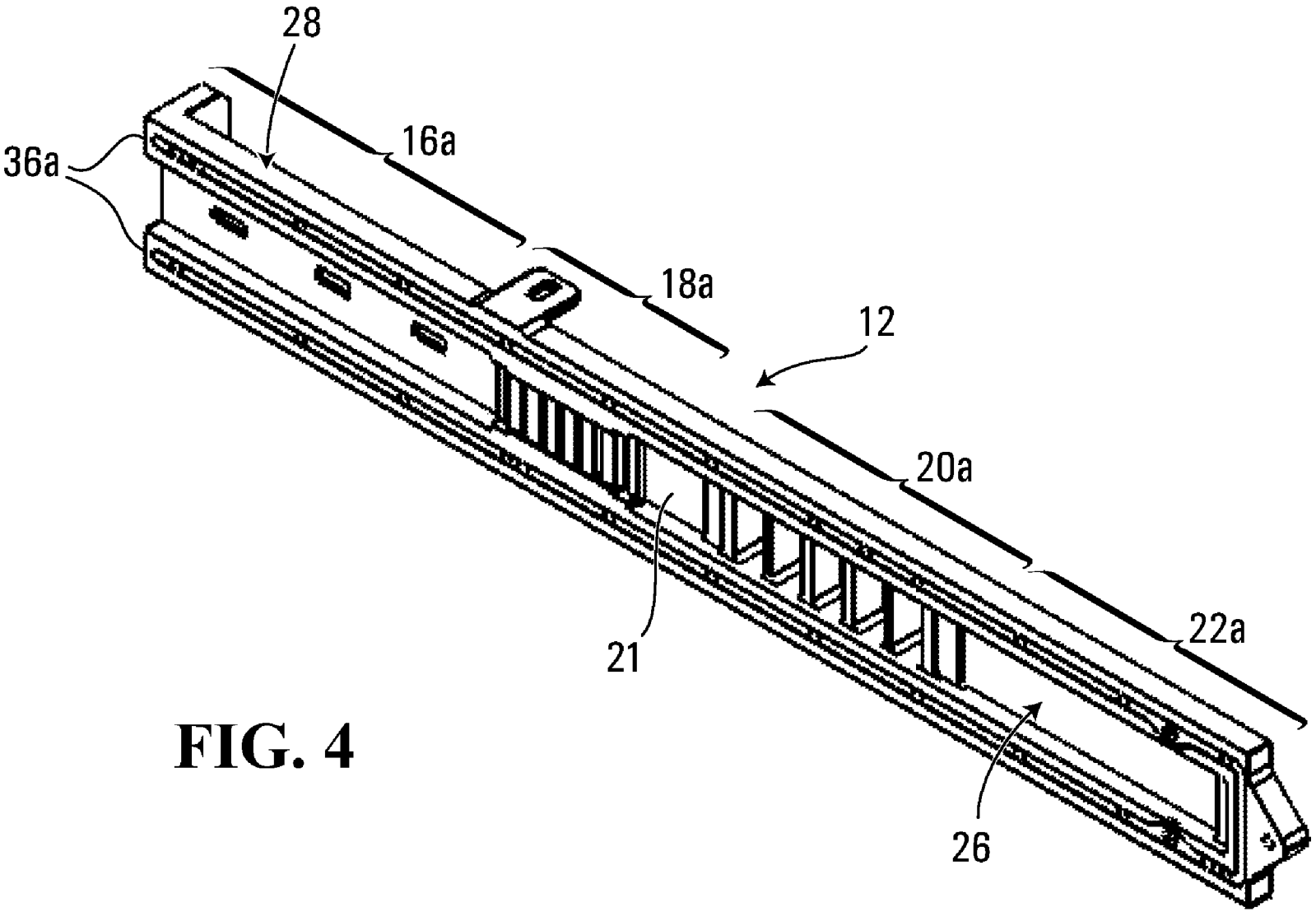
FIG. 4 shows a perspective view of a first portion of the waveguide assembly of FIG. 1.
Figure 5:
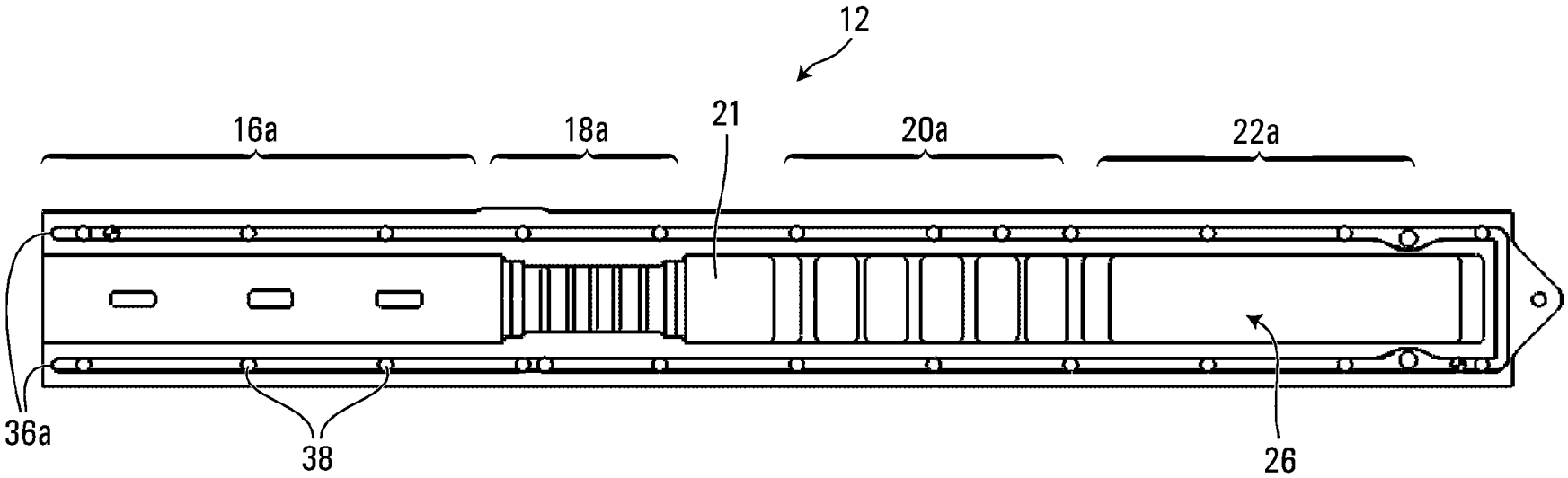
FIG. 5 shows a front plan view of the first portion of the waveguide assembly shown in FIG. 4.
Figure 6:
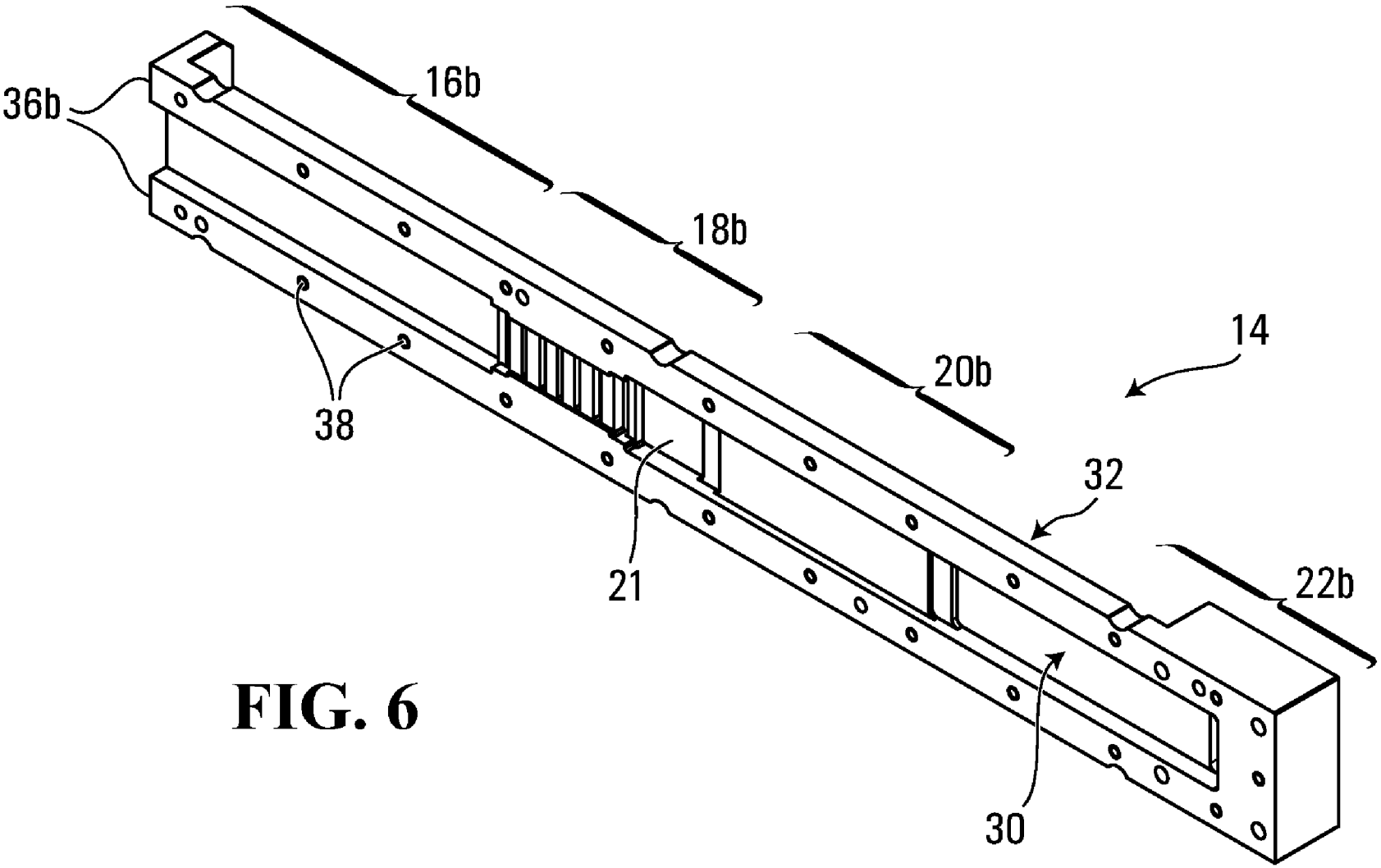
FIG. 6 shows a perspective view of a second portion of the waveguide assembly of FIG. 1.
Figure 7:
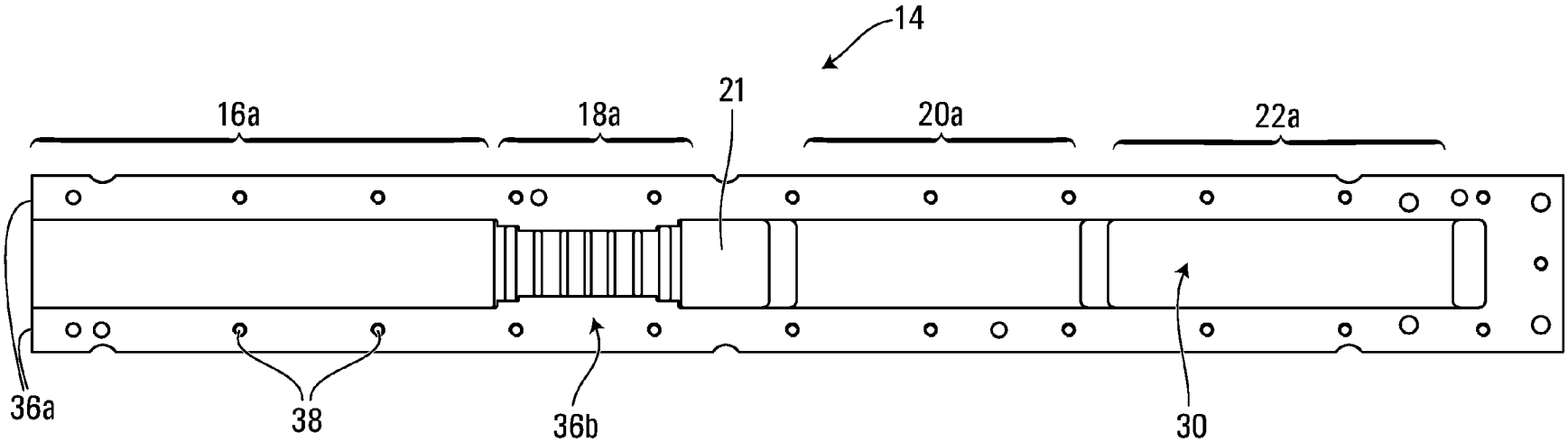
FIG. 7 shows a front plan view of the second portion of the waveguide assembly shown in FIG. 6.

With reference to FIGS. 4 and 5, the first portion 12 of the waveguide assembly 10 defines a first portion 16*a* of the monitoring coupler 16, a first portion 18*a* of the harmonic filter 18, a first portion 20*a* of the transmit filter 20 and a first portion 22*a* of the e-bend 22. In addition, and as shown in FIGS. 6 and 7, the second portion 14 of the waveguide assembly 10 defines a second portion 16*b* of the monitoring coupler 16, a second portion 18*b* of the harmonic filter 18, a second portion 20*b* of the transmit filter 20 and a second portion 22*b* of the e-bend 22. When the first portion 12 and the second portion 14 of the waveguide assembly 10 are coupled together, the first portions 16*a*, 18*a*, 20*a* and 22*a* and the second portions 16*b*, 18*b*, 20*b* and 22*b* are joined together such that the complete waveguide components 16, 18, 20 and 22 are formed within the assembled waveguide assembly 10. In this manner, the waveguide assembly 10, which requires the assembly of only the first portion 12 and the second portion 14, includes the functionality of each of the four waveguide components. Although waveguide assembly 10 comprises four different waveguide components 16, 18, 20 and 22, it should be appreciated that the waveguide assembly 10 could include a different number of waveguide components without departing from the spirit of the invention, so long as there are at least two waveguide components included therein.

The first waveguide portion 12 and the second waveguide portion 14 of the waveguide assembly 10 will now be described in more detail. As shown in FIGS. 4 and 5, the first waveguide portion 12 of the waveguide assembly 10 includes an interior surface 26 and an exterior surface 28. In addition, and as shown in FIGS. 6 and 7, the second waveguide portion 14 of the waveguide assembly 10 also includes an interior surface 30 and an exterior surface 32.

As shown in FIG. 1, the exterior surfaces 28 and 32 of the first and second waveguide portions 12 and 14 form the outside of the waveguide assembly 10 that can be seen when the first portion 12 and the second portion 14 are connected together.

The interior surface 26 of the waveguide portion 12 defines the first portions 16*a*, 18*a*, 20*a* and 22*a* of the waveguide components 16, 18, 20 and 22. Likewise the interior surface 30 of the waveguide portion 14 defines the second portions 16*b*, 18*b*, 20*b* and 22*b* of the waveguide components 16, 18, 20 and 22. More specifically, the interior surfaces 26 and 30 each define a portion of the inside shape of the waveguide components 16, 18, 20 and 22. It is the inside shape of each waveguide component that gives the waveguide component its functionality.

When the first waveguide portion 12 and the second waveguide portion 14 of the waveguide assembly are coupled together, the first portions 16*a*, 18*a*, 20*a* and 22*a* of the waveguide components align with second portions 16*b*, 18*b*, 20*b* and 22*b* of the waveguide components. As such, the combination of the interior surface 26 of the first waveguide portion 12 and the interior surface 30 of the second waveguide portion 14 together define the complete inside shapes of the waveguide components 16, 18, 20 and 22. It should be appreciated that the inside shapes of these waveguide components can vary greatly. Shown in FIGS. 1 through 7 is only one example of the four waveguide components. The shapes of the four waveguide components are well known to those of skill in the art, and as such will not be described in more detail herein.

In accordance with the present invention, the first portions 16*a*, 18*a*, 20*a* and 22*a* of the waveguide components can form approximately half of the inside shape of the waveguide components. Alternatively, they can form any percentage thereof. For example, the first portions 16*a*, 18*a*, 20*a* and 22*a* can define anywhere from 5% to 95% of the inside shape of each of the waveguide components. Likewise, the second portions 16*b*, 18*b*, 20*b* and 22*b* can also define anywhere from 5% to 95% of the inside shape of each of the waveguide components. It should, however, be appreciated that although the percentage of the inside shape defined by each of the first waveguide portion 12 and second waveguide portion 14 can vary, the first portions 16*a*, 18*a*, 20*a* and 22*a* and the second portions 16*b*, 18*b*, 20*b* and 22*b* together define 100% of the inside shape of each of the waveguide components.

As shown in FIGS. 4 through 7, the first portion 12 and the second portion 14 of the waveguide assembly 10 include mating rims 36*a*, 36*b*, respectively. In order to couple the first waveguide portion 12 and the second waveguide portion 14 together, the two mating rims 36*a* and 36*b* are put face to face, and are then secured together. In the non-limiting embodiment shown, each of the mating rims 36*a* and 36*b* includes holes 38 therein for receiving screws (not shown). As such, the screws are used in order to secure the first and second portions 12 and 14 together. It should be appreciated that any other type of mechanical fastener, such as rivets, nuts and bolts, or any other suitable fastener known in the industry could be used, without departing from the spirit of the invention. By using such mechanical fasteners, the first waveguide portion 12 and the second waveguide portion 14 are joined together such that they are removably connected together. As such, the first waveguide portion 12 and the second portion 14 can be taken apart to access the interior of the waveguide assembly 10, in the case where one or both of the portions need to be modified or repaired.

In an alternative embodiment, the first waveguide portion 12 and the second portion 14 can be fastened together in a permanent manner, wherein the two mating rims 36*a* and 36*b* are joined together via welding, for example. In such an embodiment, the first waveguide portion 12 and the second waveguide portion 14 cannot be separated without causing damage to the two portions 12 and 14.

Referring back to FIG. 1, the interface 33 between the first waveguide portion 12 and the second waveguide portion 14 (which is created when the two mating rims 36*a* and 36*b* are joined together) is positioned in the x-z plane, with respect to the coordinate system shown. As such, it can be said that the waveguide assembly "breaks" along the x-z plane. From an electrical standpoint, "breaking" the waveguide components 16, 18, 20 and 22 along the x-z plane, causes the waveguide assembly 10 to be cut perpendicular to the flow of the current lines of the dominant mode. However, from a mechanical standpoint, "breaking" the waveguide assembly 10 along the x-z plane simplifies the machining access for machining the fine details of each of the waveguide components. It thus allows the machining tools to access the first portion 12 and second portion 14 in such a way to enable high precision machining. This ability to perform detailed machining reduces the requirement for tuning the waveguide assembly 10 post-manufacturing. This makes the waveguide assembly 10 both faster and cheaper to manufacture, since less components and time are required for tuning. In an alternative embodiment, the "break" in the waveguide assembly 10 could occur in a different orientation, such as along the x-y plane, for example. In such a configuration, the first waveguide portion 12 and the second waveguide portion 14 would be positioned in a side-by-side relationship, and not an up-down relationship.

Referring back to FIGS. 1, 2 and 3, at one end of the waveguide assembly 10 is an e-bend 22 that is suitable for allowing the waveguide assembly 10 to be connected to an external device. Located at the opposite end of the waveguide assembly 10 is a connecting interface 24 that is suitable for allowing the waveguide assembly 10 to be connected to an input device. As such, the waveguide assembly 10 has an input end and an output end. In the embodiment shown, the connecting interface 24 is a separate component from the first and second waveguide portions 12, 14 of the waveguide assembly 10. It should, however, be appreciated that in an alternative embodiment, each of the first waveguide portion 12 and the second waveguide portion 14 could include a portion of the connecting interface 24, such that the connecting interface 24 would be an integral part of the waveguide assembly 10.

As described above, waveguide assembly 10 incorporates multiple waveguide components (namely components 16, 18, 20 and 22) into a single waveguide assembly 10 that is formed of two waveguide portions.

Waveguide Assembly 40—Second Non-Limiting Embodiment

Figure 8:
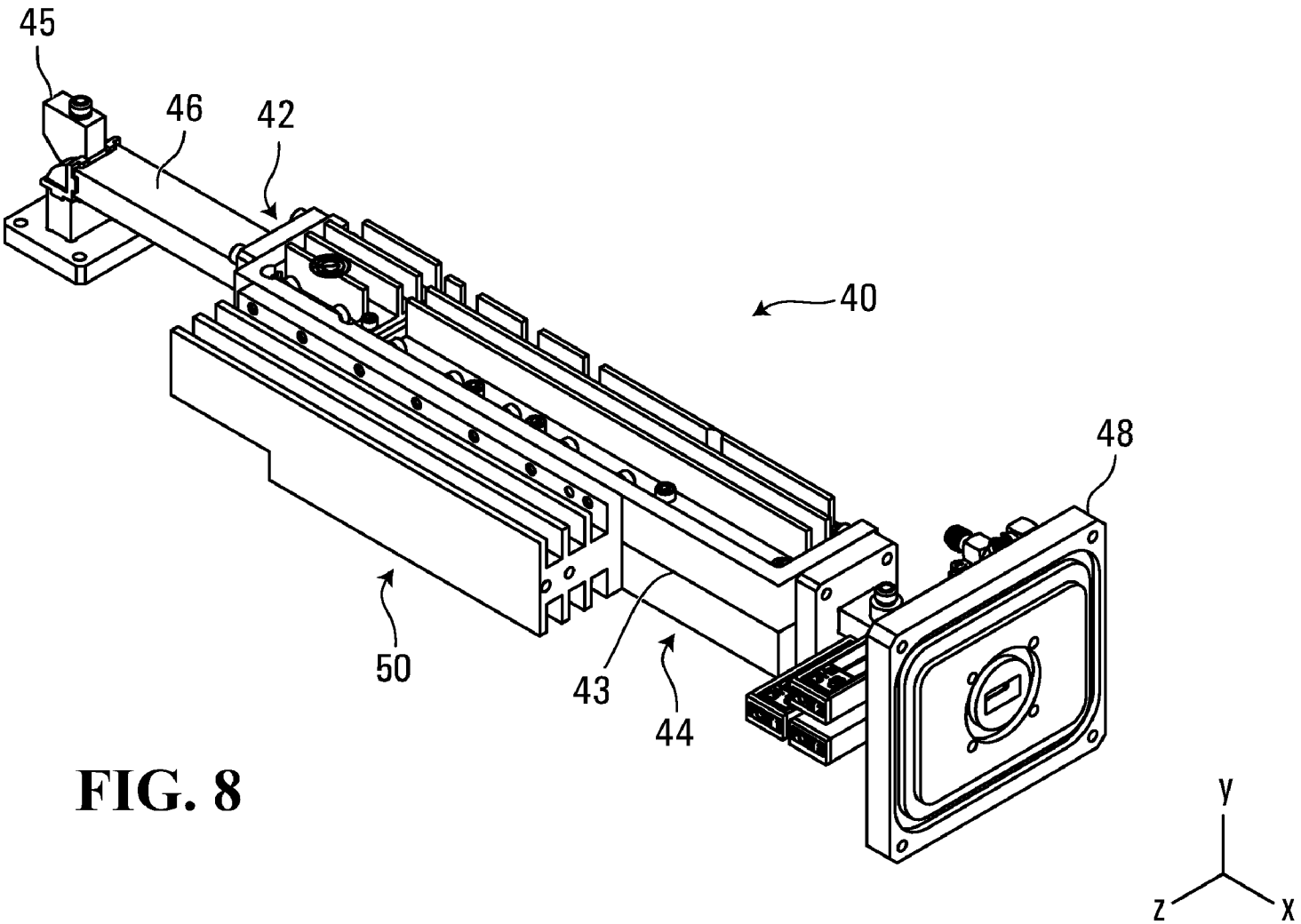
FIG. 8 shows a front perspective view of a waveguide assembly in accordance with a second non-limiting example of implementation of the present invention.
Figure 9:
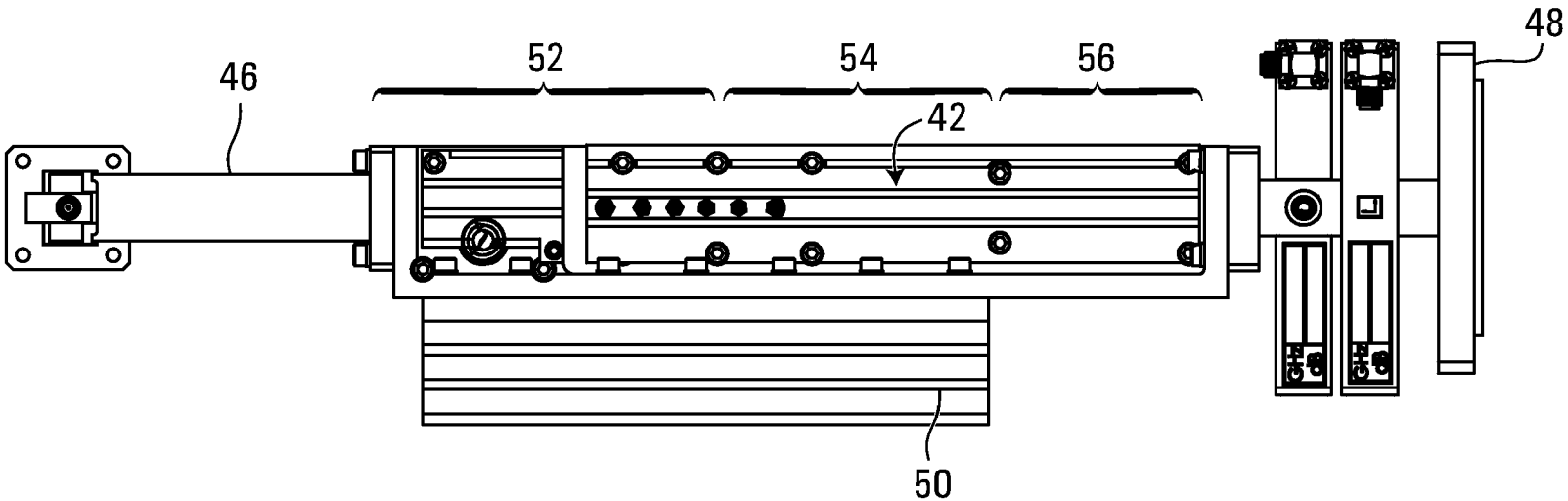
FIG. 9 shows a top plan view of the waveguide assembly of FIG. 8.
Figure 10:
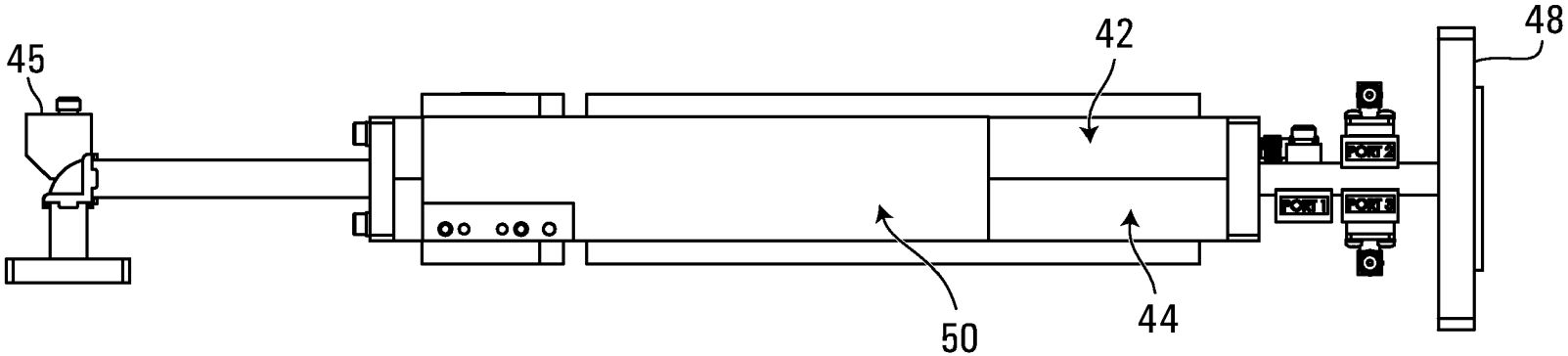
FIG. 10 shows a side plan view of the waveguide assembly of FIG. 8.

Shown in FIGS. 8, 9 and 10 is a waveguide assembly 40 in accordance with a second non-limiting example of implementation of the present invention. Waveguide assembly 40 comprises a first waveguide portion 42 and a second waveguide portion 44, that when coupled together, form the complete waveguide assembly 40. As shown in FIGS. 11 through 14, the first waveguide portion 42 of the waveguide assembly 40 and the second waveguide portion 44 of the waveguide assembly 40 each define a portion of three separate waveguide components, which in the embodiment shown are an isolator 52 (which is a circulator having a terminating arm), a harmonic filter 54 and a transmit filter 56. The functionality of each of these individual components is known in the field of microwave waveguides, and as such will not be described in more detail herein.

Figure 11:
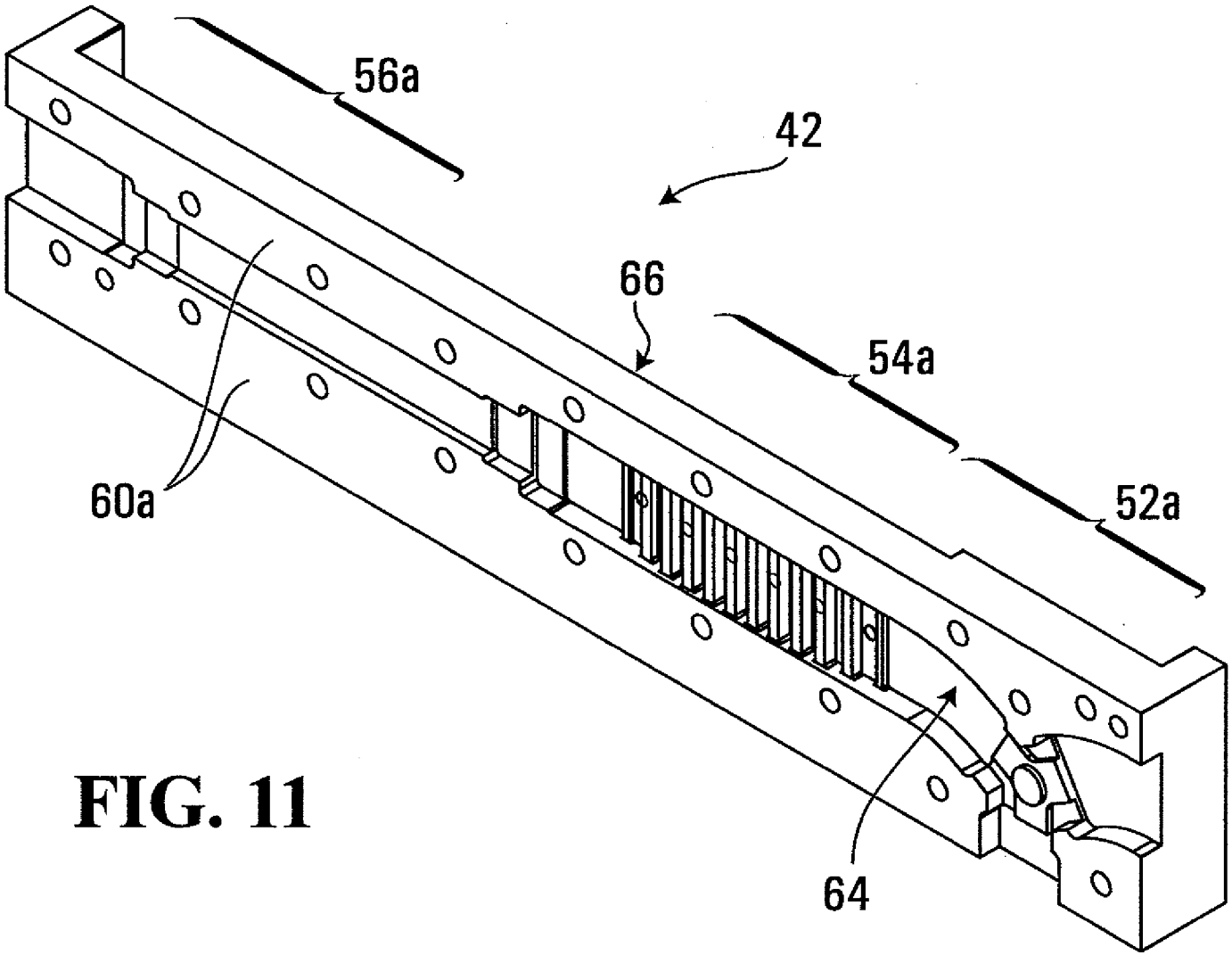
FIG. 11 shows a perspective view of a first portion of the waveguide assembly of FIG. 8.
Figure 12:
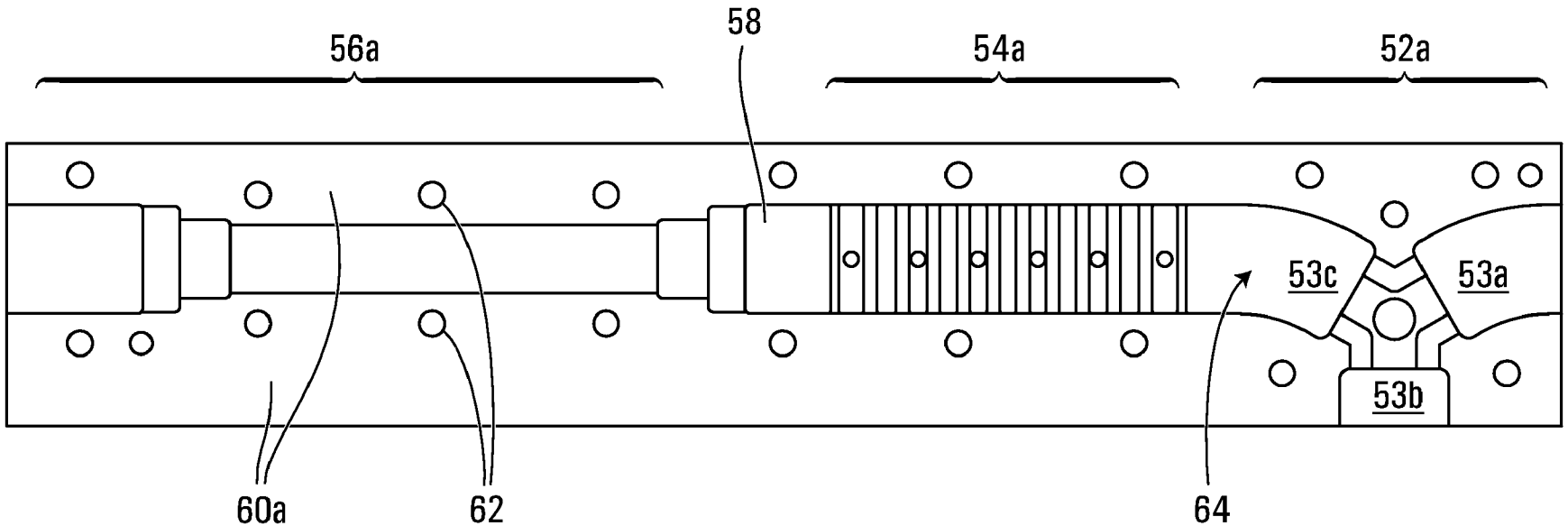
FIG. 12 shows a front plan view of the first portion of the waveguide assembly shown in FIG. 11.
Figure 13:
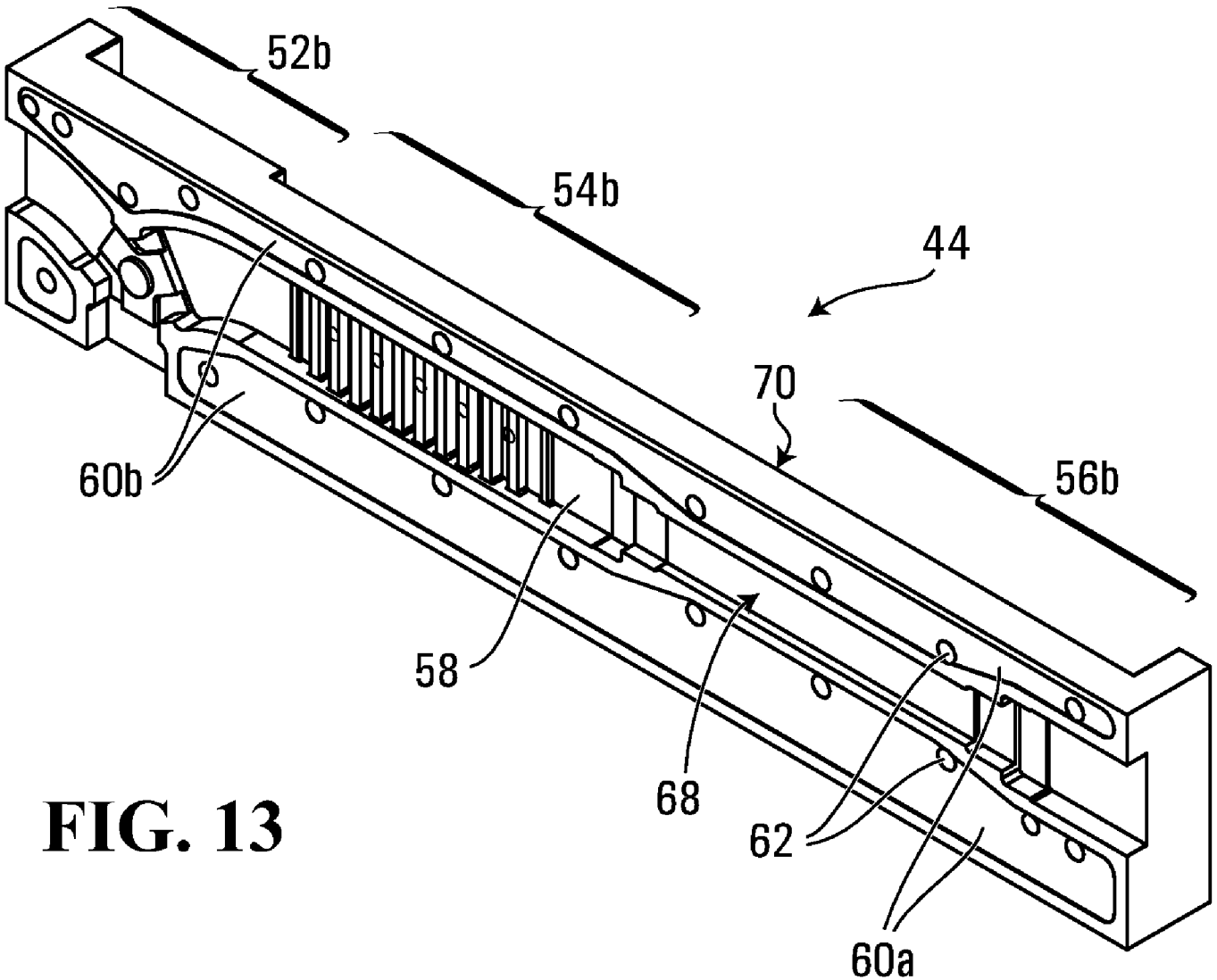
FIG. 13 shows a perspective view of a second portion of the waveguide assembly of FIG. 8.
Figure 14:
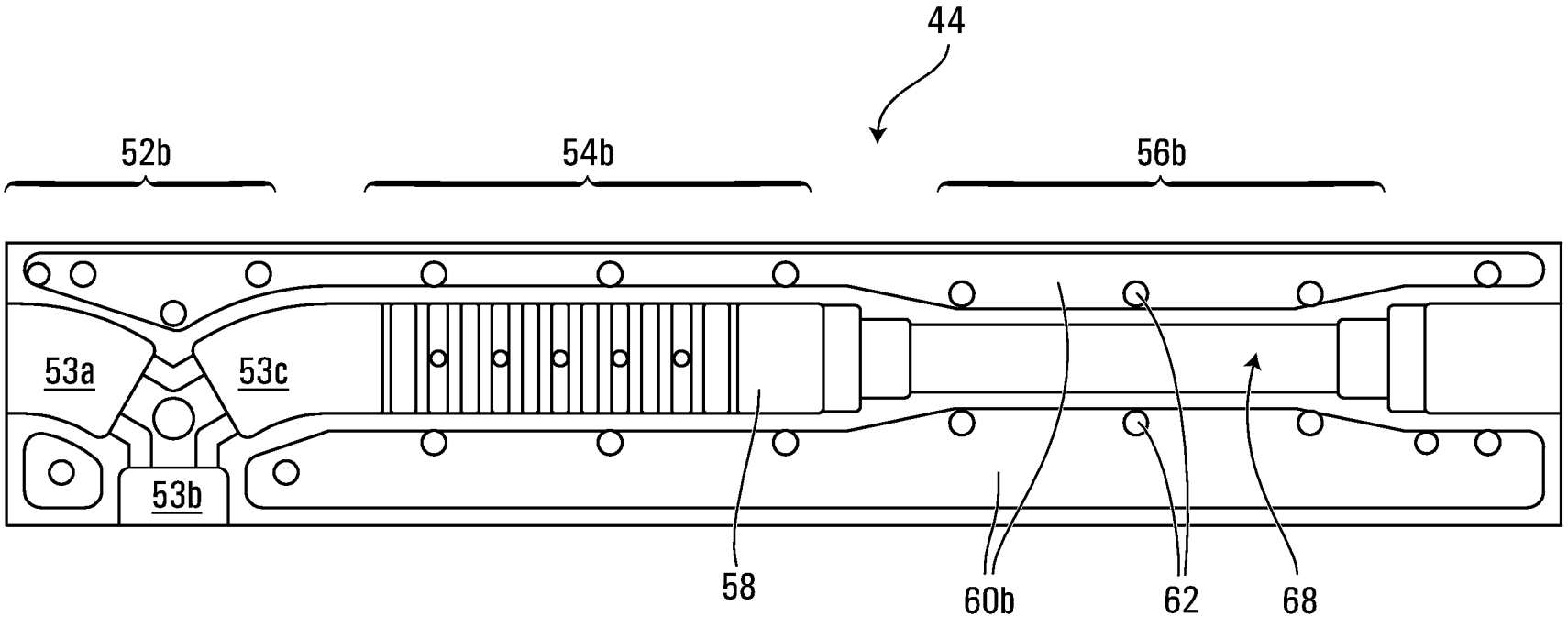
FIG. 14 shows a front plan view of the second portion of the waveguide assembly shown in FIG. 13.

As shown in FIGS. 11 and 12, the first waveguide portion 42 of the waveguide assembly 10 defines a first portion 52*a* of the isolator 52, a first portion 54*a* of the harmonic filter 54, and a first portion 56*a* of the transmit filter 56. In addition, and as shown in FIGS. 13 and 14, the second portion 44 of the waveguide assembly 10 defines a second portion 52*b* of the isolator 52, a second portion 54*b* of the harmonic filter 54 and a second portion 56*b* of the transmit filter 56. When the first portion 42 and the second portion 44 of the waveguide assembly 40 are coupled together, the first portions 52*a*, 54*a* and 56*a* and the second portions 52*b*, 54*b* and 56*b* are joined together such that the complete waveguide components 52, 54 and 56 are formed within the assembled waveguide assembly 40. In this manner, the waveguide assembly 40, which requires the assembly of only the first portion 42 and the second portion 44, includes the functionality of each of the three waveguide components. Although waveguide assembly 40 comprises three different waveguide components, it should be appreciated that the waveguide assembly 40 could include a different number of waveguide components, so long as there are at least two waveguide components included therein.

The first waveguide portion 42 and the second waveguide portion 44 of the waveguide assembly 40 will now be described in more detail. As shown in FIGS. 11 and 12, the first waveguide portion 42 of the waveguide assembly 40 includes an interior surface 64 and an exterior surface 66. In addition, and as shown in FIGS. 13 and 14, the second waveguide portion 44 of the waveguide assembly 40 includes an interior surface 68 and an exterior surface 70. The interior surfaces 64 and 68 of the two waveguide portions 42 and 44 define respectively the first portions 52*a*, 54*a*, 56*a* of the waveguide components and the second portions 52*b*, 54*b*, 56*b* of the waveguide components. More specifically, the interior surfaces 64 and 68 each define a portion of the inside shape of the waveguide components 52, 54 and 56.

As shown in FIG. 8, the exterior surfaces 66 and 70 of the first and second portions 42 and 44 form the outside of the waveguide assembly 40 that can be seen when the first portion 42 and the second portion 44 are connected together.

When the first portion 42 and the second portion 44 of the waveguide assembly are coupled together, the first portions 52*a*, 54*a*, 56*a* of the waveguide components align with second portions 52*a*, 54*b* 56*b* of the waveguide components. As such, the combination of the interior surface 64 of the first portion 12 and the interior surface 68 of the second portion 14 together define the complete inside shape of the waveguide components 52, 54 and 56. The inside shape of these waveguide components can vary greatly depending on the specific implementation of the waveguide component. Shown in FIGS. 8 through 14 is one example of the three waveguide components shown. The inside shapes of the three waveguide components are well known to those of skill in the art, and as such will not be described in more detail herein.

In accordance with the present invention, the first portions 52*a*, 54*a* and 56*a* of the waveguide components can form approximately half of the inside shape of the waveguide components. Alternatively, they can form any percentage thereof. For example, the first portions 52*a*, 54*a* and 56*a* can define anywhere from 5% to 95% of the inside shape of the waveguide components. Likewise, the second portions 52*b*, 54*b* and 56*b* can also define anywhere from 5% to 95% of the inside shape of the waveguide components. It should, however, be appreciated that although the percentage of the inside shape defined by each of the first portion and second portion can vary, the first portions 52*a*, 54*a* and 56*a* and the second portions 52*b*, 54*b* and 56*b* of the waveguide components together define 100% of the inside shape of the waveguide components.

As shown in FIGS. 8 through 14, the first portion 42 and the second portion 44 of the waveguide assembly 40 include mating rims 60*a* and 60*b*, respectively. In order to couple the first portion 42 and the second portion 44 together, the two mating rims 60*a* and 60*b* are put face to face, and are then secured together. In the non-limiting embodiment shown, each of the mating rims 60*a* and 60*b* include holes 62 therein for receiving screws (not shown). As such, the screws are used in order to secure the first and second waveguide portions 42 and 44 together. It should be appreciated that any other type of mechanical fastener, such as rivets, nuts and bolts, or any other suitable fastener known in the industry could be used, without departing from the spirit of the invention. By using such mechanical fasteners, the first waveguide portion 42 and the second waveguide portion 44 are joined together such that they are removable connected together. As such, the first waveguide portion 42 and the second waveguide portion 44 can be taken apart to access the interior of the waveguide assembly 40, in the case where one or both of the portions need to be modified or repaired.

In an alternative embodiment, the first portion 42 and the second portion 44 can be fastened together in a permanent manner, wherein the two mating rims 60*a* and 60*b* are joined together via welding, for example. In such an embodiment, the first portion 42 and the second portion 44 are joined such that they cannot be separated without causing damage to the two portions 42 and 44.

Referring back to FIG. 8, the interface 43 between the first portion 42 and the second portion 44 (which is created when the two mating rims 60*a* and 60*b* are joined together) is positioned in the x-z plane with respect to the coordinate system shown. As such, it can be said that the waveguide assembly "breaks" along the x-z plane. From an electrical standpoint, "breaking" the waveguide components 52, 54 and 56 along the x-z plane, causes the waveguide assembly 40 to be cut perpendicular to the flow of the current lines of the dominant mode. However, from a mechanical standpoint it simplifies the machining access for machining the fine details of each of the waveguide components. It thus allows the machining tools to access the first portion and the second portion in such a way to enable high precision machining. This ability to perform detailed machining reduces the requirement for tuning the waveguide assembly 40 post-manufacturing. This makes the waveguide assembly 40 both faster and cheaper to manufacture, since less components and time are required for tuning. In an alternative embodiment, the "break" in the waveguide components could occur along the x-y plane. In such a configuration, the first portion 42 and the second portion 44 would be positioned in a side-by-side relationship, and not an up-down relationship.

Referring back to FIGS. 8, 9 and 10, an e-bend 46 is connected to one end of the waveguide assembly 40 and is suitable for allowing the waveguide assembly 10 to be connected to an external device. In the case of waveguide assembly 40, the e-bend 46 is a separate component that is attached to one end of the waveguide assembly 40. Positioned on the e-bend 46 is an arc-detector 45, which are known in the art and will not be described in more detail herein. Located at the opposite end of the waveguide assembly 10 is a connecting interface 48 that is suitable for allowing the waveguide assembly 40 to be connected to an input device. In the embodiment shown, the connecting interface 48 is a separate component from the first and second portions 42, 44 of the waveguide assembly 40. It should, however, be appreciated that in an alternative embodiment, each of the first portion 42 and the second portion 44 could include a portion of the connecting interface 48, such that the connecting interface 48 would be an integral part of the waveguide assembly 40.

In addition, and as best shown in FIGS. 8 and 9, attached to one side of the waveguide assembly 40 is a terminator 50 for the isolator 52. As shown in FIGS. 12 and 14, the isolator 52 has three arms 53*a*, 53*b* and 53*c*. The termination 50 is connected to waveguide arm 53*b* to absorb the energy reflected by the harmonic filter 54 and the energy lost during the transmission of the energy from waveguide arm 53*a* to waveguide arm 53*c* (this energy is lost because the circulator doesn't have a perfect isolation). As such, the terminator 50 is designed to absorb, and dissipate, the heat caused by the waveguide energy that flows into waveguide arm 53*b*. As shown, the terminator 50 is a separate component that is mounted to the waveguide assembly 40. It should be appreciated that in an alternative embodiment, the termination 50 could be integrally formed by the first and second waveguide portions 42, 44 of the waveguide assembly 40.

As described above, waveguide assembly 40 incorporates multiple waveguide components (namely components 52, 54 and 56) into a single waveguide assembly 40 that is formed of two waveguide portions 42 and 44.

Waveguide Assembly 80—Third Non-Limiting Embodiment

Figure 15:
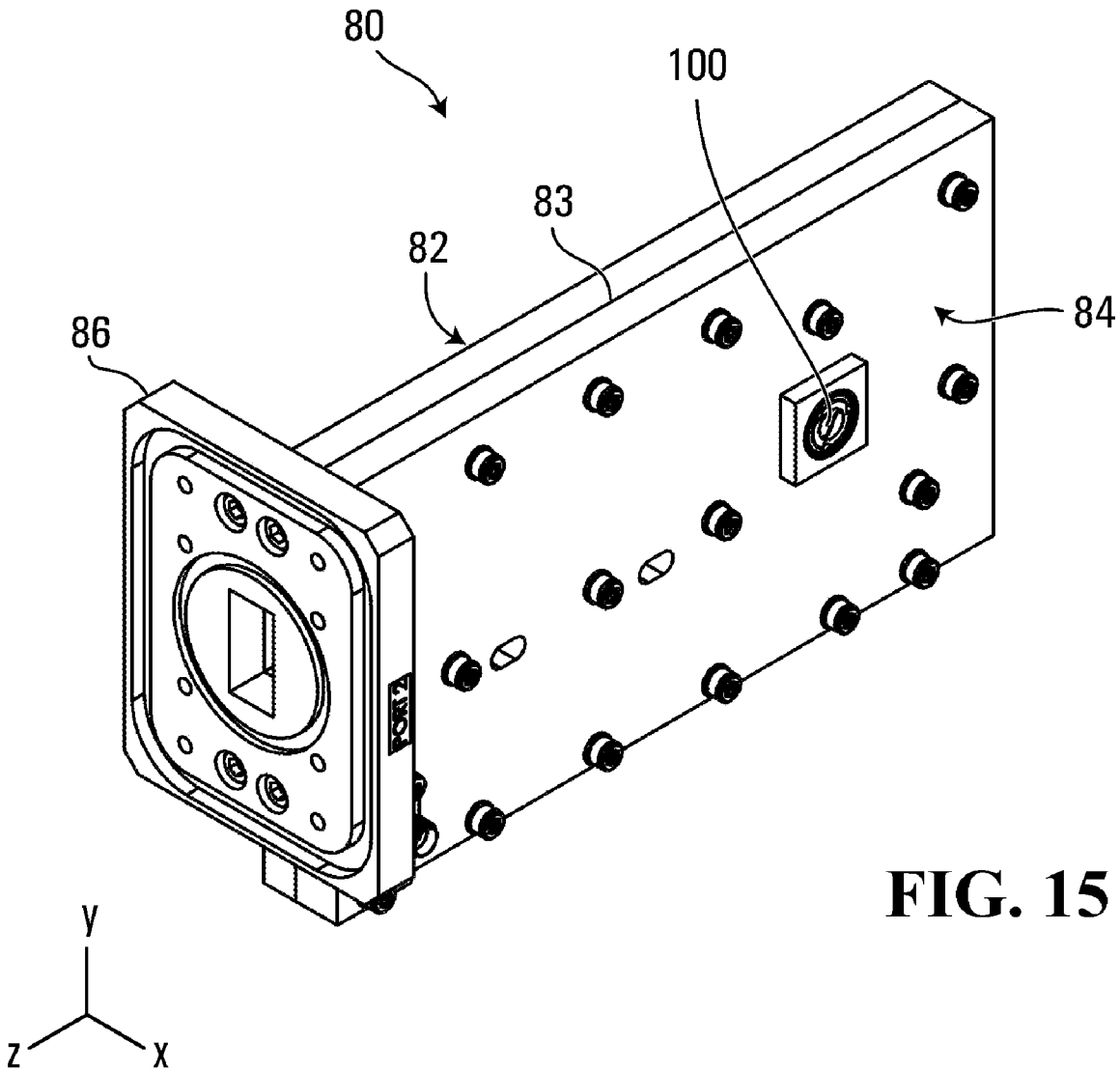
FIG. 15 shows a front perspective view of a waveguide assembly in accordance with a third non-limiting example of implementation of the present invention.
Figure 16:
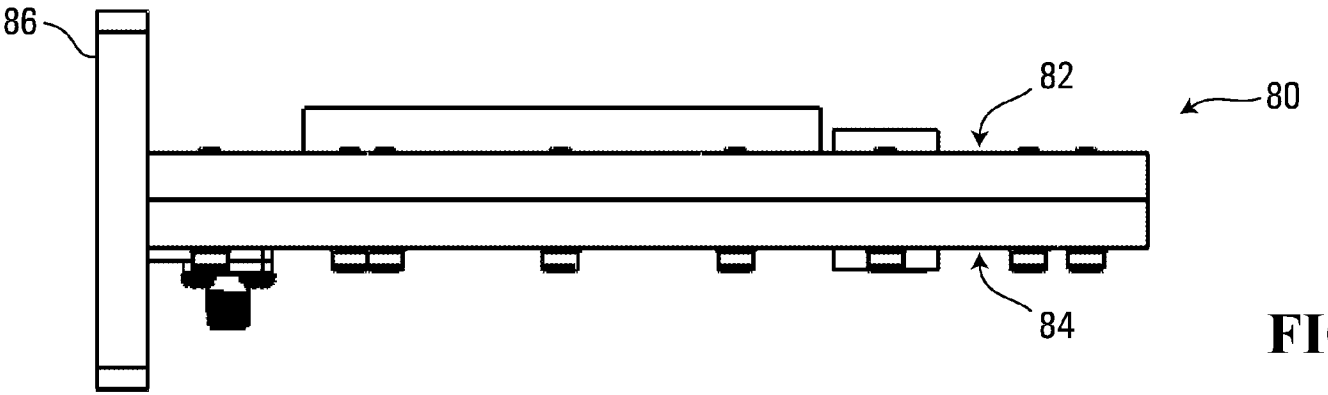
FIG. 16 shows a top plan view of the waveguide assembly of FIG. 15.
Figure 17:
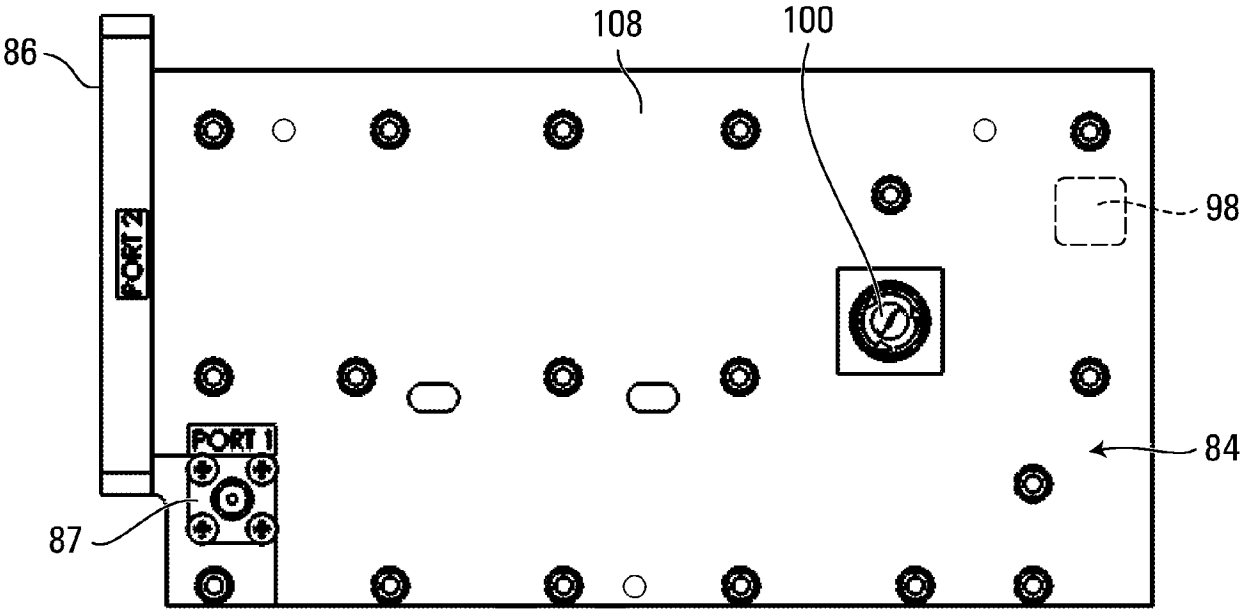
FIG. 17 shows a side plan view of the waveguide assembly of FIG. 15.

Shown in FIGS. 15, 16 and 17 is a waveguide assembly 80 in accordance with a second non-limiting example of implementation of the present invention. Waveguide assembly 80 comprises a first waveguide portion 82 and a second waveguide portion 84, that when coupled together, form the complete waveguide assembly 80. As shown in FIGS. 18 through 21, the first waveguide portion 82 of the waveguide assembly 80 and the second waveguide portion 84 of the waveguide assembly 80 each define a portion of three separate waveguide components, which in the embodiment shown are an isolator 92 (which is a circulator having a terminating arm), a harmonic filter 94 and a transmit filter 96. The functionality of each of these individual components is known in the field of microwave waveguides, and as such will not be described in more detail herein.

Figure 18:
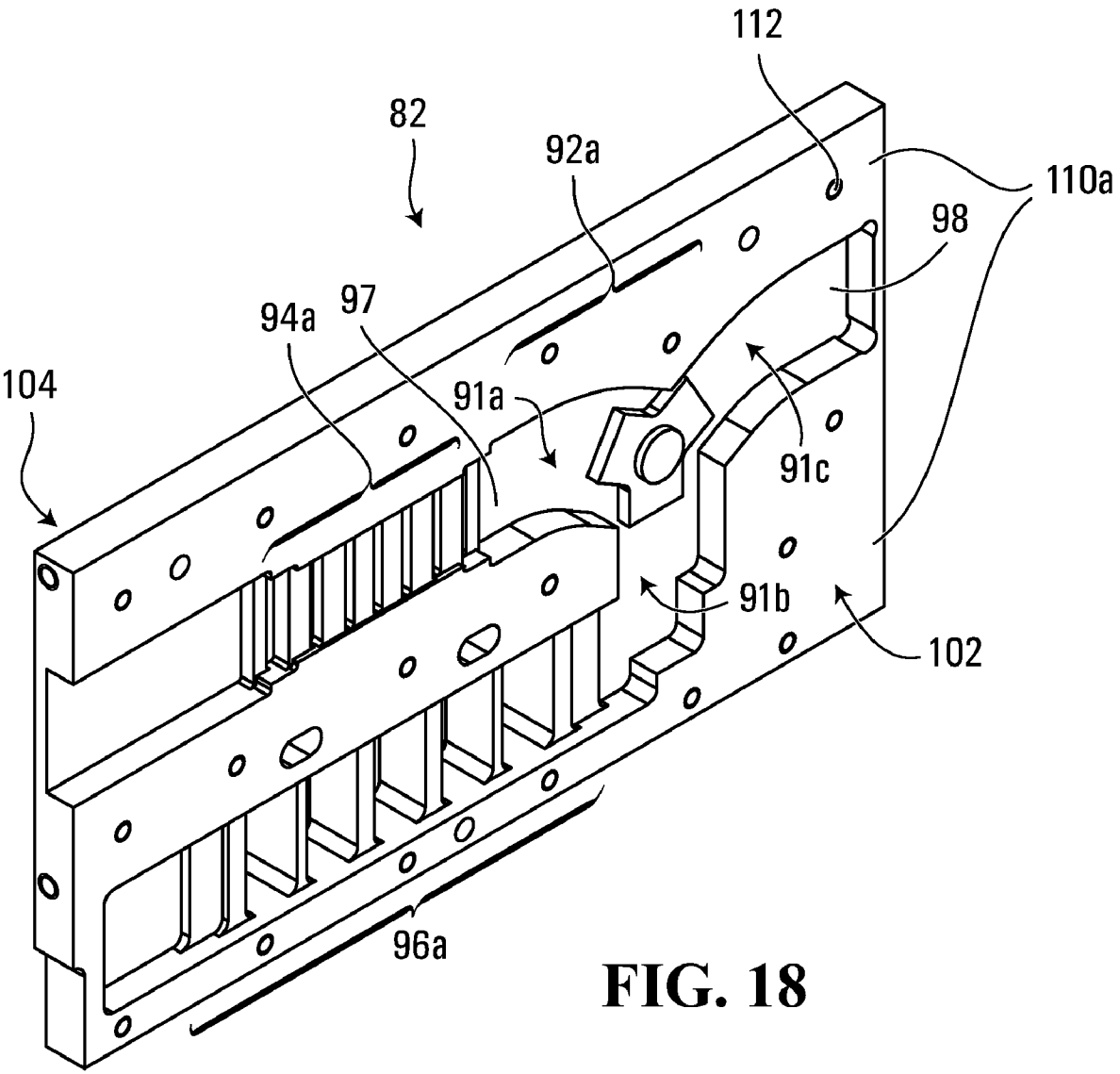
FIG. 18 shows a perspective view of a first portion of the waveguide assembly of FIG. 15.
Figure 19:
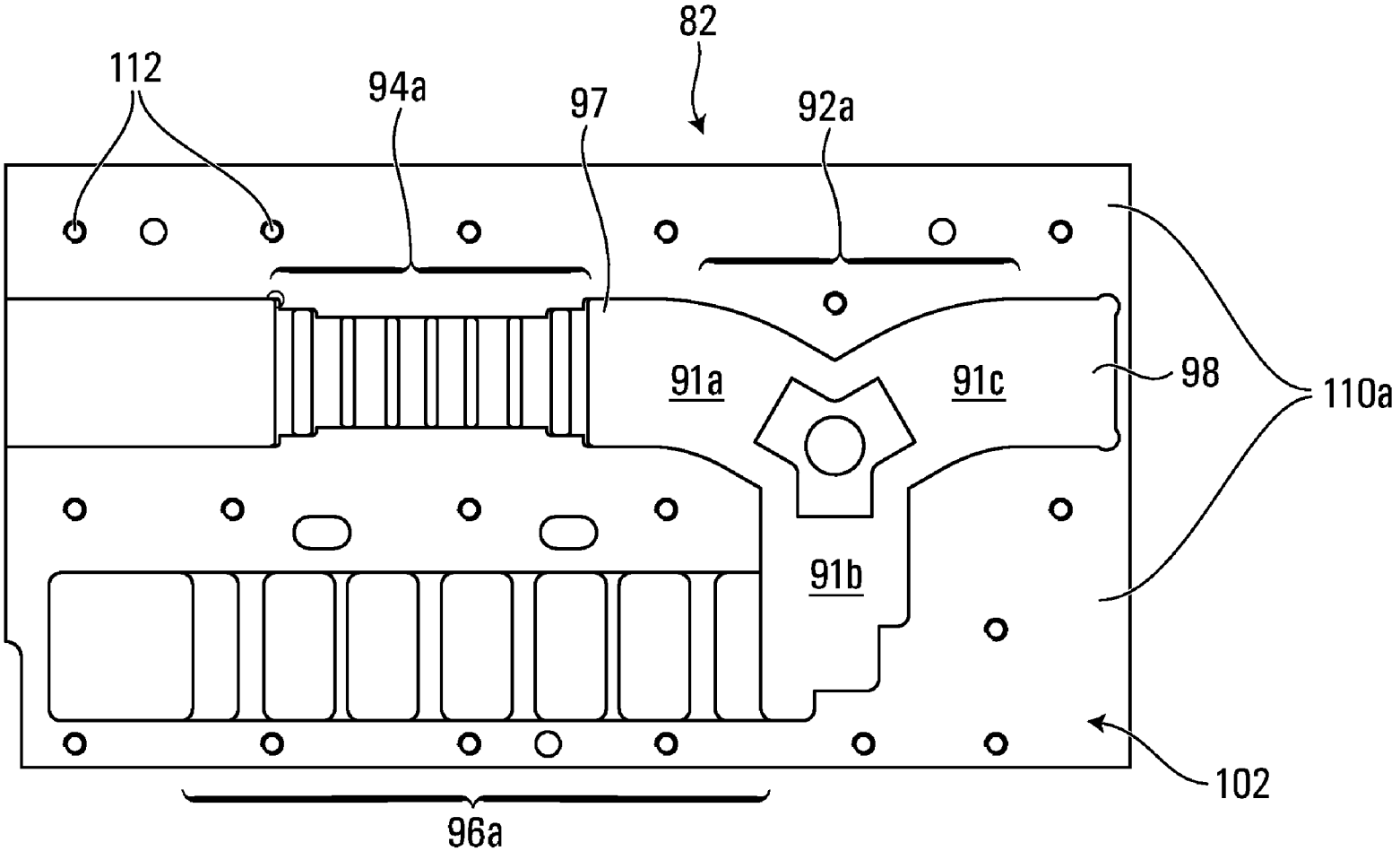
FIG. 19 shows a front plan view of the first portion of the waveguide assembly shown in FIG. 18.
Figure 20:
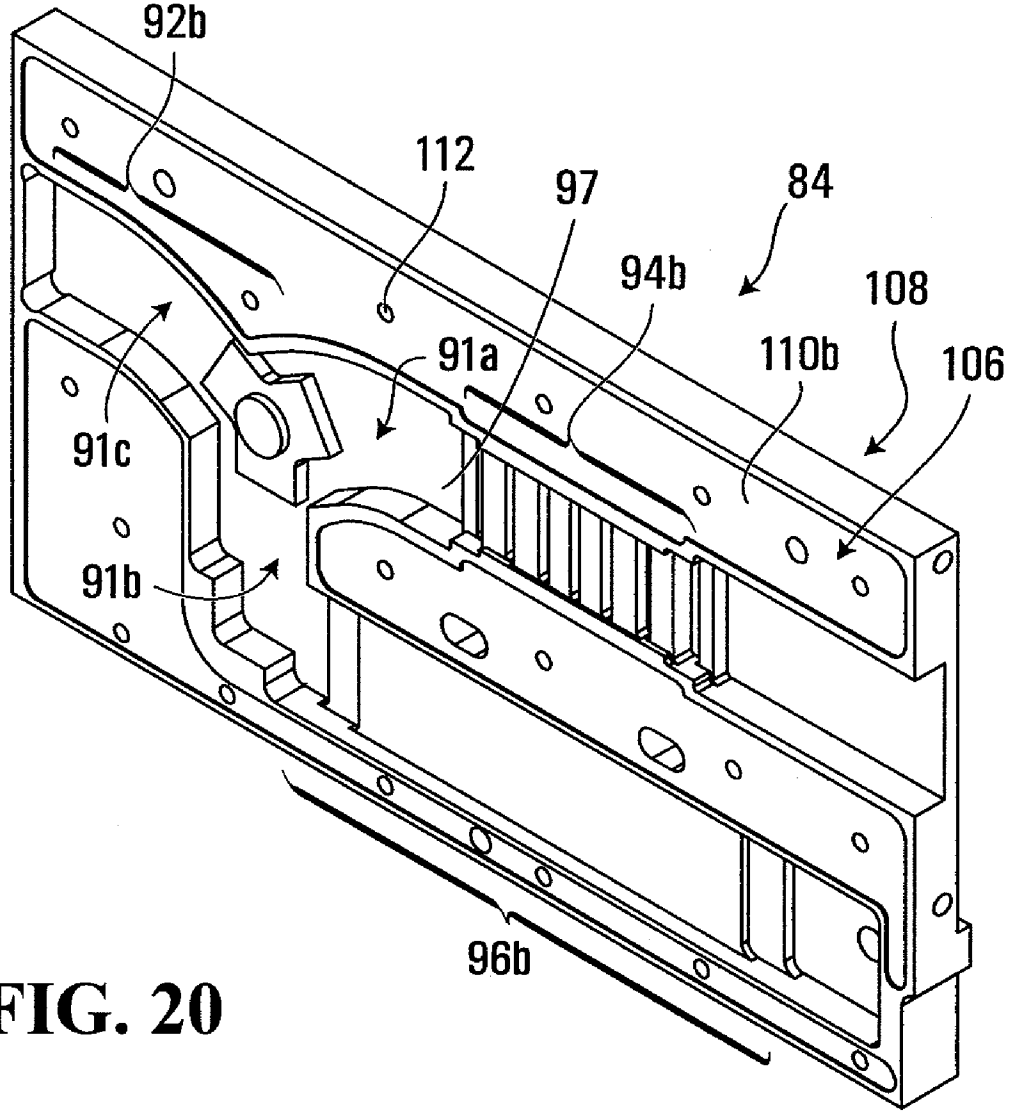
FIG. 20 shows a perspective view of a second portion of the waveguide assembly of FIG. 15.
Figure 21:
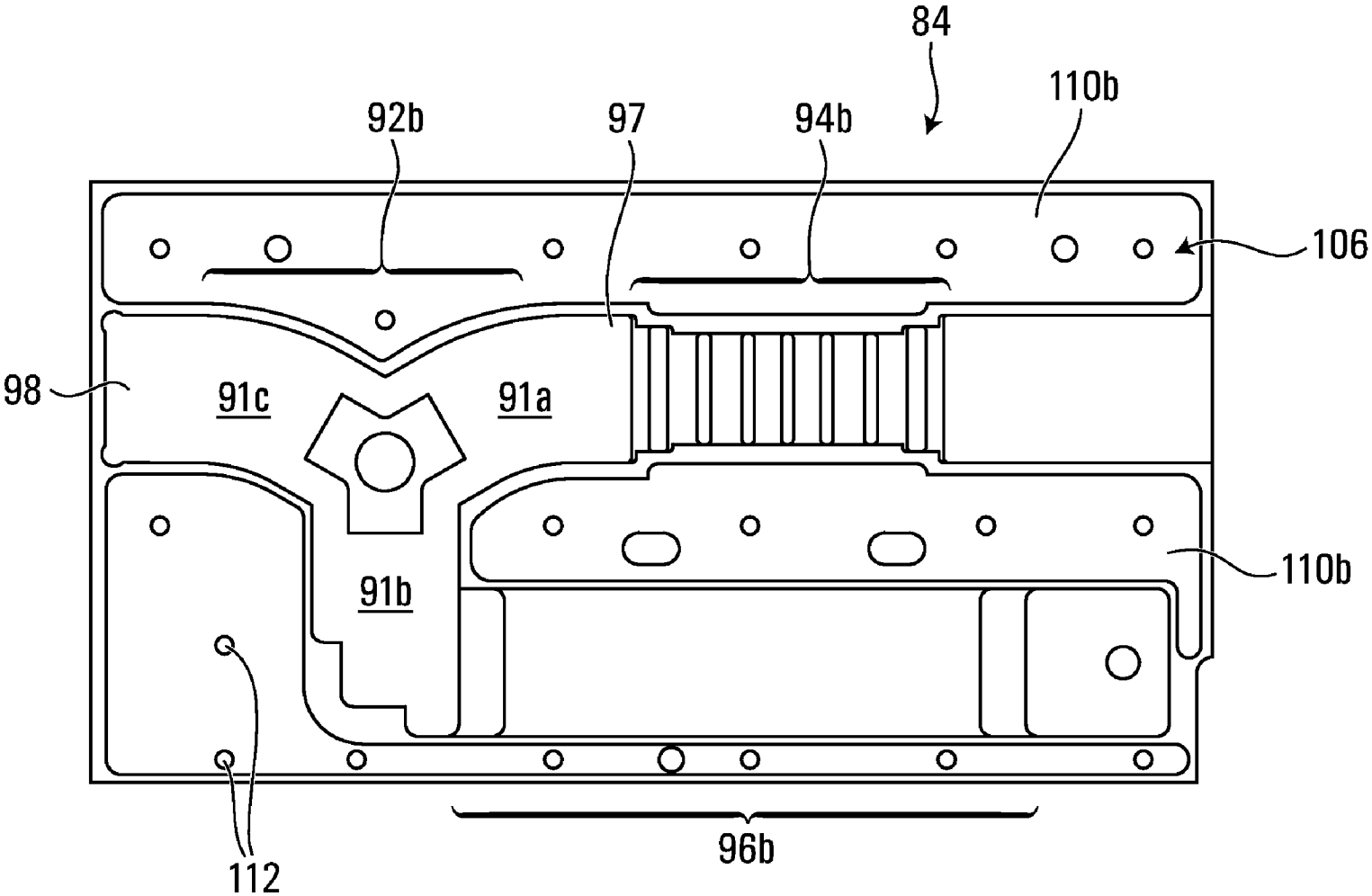
FIG. 21 shows a front plan view of the second portion of the waveguide assembly shown in FIG. 20.

As shown in FIGS. 18 and 19, the first waveguide portion 82 of the waveguide assembly 80 defines a first portion 92*a* of the isolator 92, a first portion 94*a* of the harmonic filter 94, and a first portion 96*a* of the transmit filter 96. In addition, and as shown in FIGS. 20 and 21, the second waveguide portion 84 of the waveguide assembly 80 defines a second portion 92*b* of the isolator 92, a second portion 94*b* of the harmonic filter 94 and a second portion 96*b* of the transmit filter 96. When the first portion 82 and the second portion 84 of the waveguide assembly 80 are coupled together, the first portions 92*a*, 94*a* and 96*a* and the second portions 92*b*, 94*b* and 96*b* are joined together such that the complete waveguide components 92, 94 and 96 are formed within the assembled waveguide assembly 80. In this manner, the waveguide assembly 80, which requires the assembly of only the first portion 82 and the second portion 84, includes the functionality of each of the three waveguide components. Although waveguide assembly 80 comprises three different waveguide components, it should be appreciated that the waveguide assembly 80 could include a different number of waveguide components without departing from the spirit of the invention, so long as there are two or more waveguide components included therein.

The first waveguide portion 82 and the second waveguide portion 84 of the waveguide assembly 80 will now be described in more detail. As shown in FIG. 18, the first waveguide portion 82 of the waveguide assembly 80 includes an interior surface 102 and an exterior surface 104. In addition, and as shown in FIG. 20, the second waveguide portion 84 of the waveguide assembly 80 includes an interior surface 106 and an exterior surface 108. The interior surfaces 102 and 106 of the two waveguide portions 82 and 84 define respectively the first portions 92*a*, 94*a*, 96*a* of the waveguide components and the second portions 92*b*, 94*b*, 96*b* of the waveguide components. More specifically, the interior surfaces 102 and 106 each define a portion of an inside shape of the waveguide components 52, 54 and 56.

As shown in FIG. 15, the exterior surfaces 104 and 108 of the first and second portions 82 and 84 form the outside of the waveguide assembly 80 that can be seen when the first portion 82 and the second portion 84 are connected together.

When the first portion 82 and the second portion 84 of the waveguide assembly 80 are coupled together, the first portions 92*a*, 94*a*, 96*a* of the waveguide components align with second portions 92*b*, 94*b* 96*b* of the waveguide components. As such, the combination of the interior surface 102 of the first portion 82 and the interior surface 106 of the second portion 84 together define the shapes of the complete waveguide components; namely the isolator, the harmonic filter and the transmit filter. The shape of these waveguide components can vary greatly depending on the specific implementation of the waveguide component. Shown in FIGS. 15 through 21 is one example of the three waveguide components shown. The shapes of the three waveguide components are well known to those of skill in the art, and as such will not be described in more detail herein.

In accordance with the present invention, the first portions 92*a*, 94*a* and 96*a* of the waveguide components can form approximately half of the inside shapes of the waveguide components. Alternatively, they can form any percentage thereof. For example, the first portions 92*a*, 94*a* and 96*a* can define anywhere from 5% to 95% of the inside shape of the waveguide components. Likewise, the second portions 92*b*, 94*b* and 96*b* can also define anywhere from 5% to 95% of the inside shape of the waveguide components. It should, however, be appreciated that although the proportion of the inside shape defined by each of the first portion and second portion can vary, the first portions 92*a*, 94*a* and 96*a* and the second portions 92*b*, 94*b* and 96*b* of the waveguide components together define 100% of the inside shapes of the waveguide components.

As shown in FIGS. 15 through 21, the first portion 82 and the second portion 84 of the waveguide assembly 40 include mating rims 110*a* and 110*b*, respectively. In order to couple the first portion 82 and the second portion 84 together, the two mating rims 110*a* and 110*b* are put face to face, and are then secured together. In the non-limiting embodiment shown, each of the mating rims 110*a* and 110*b* includes holes 112 therein for receiving screws (not shown). As such, the screws are used in order to secure the first and second portions 82 and 84 together. It should be appreciated that any other type of mechanical fastener, such as rivets, nuts and bolts, or any other suitable fastener known in the industry could be used, without departing from the spirit of the invention. By using such mechanical fasteners, the first portion 82 and the second portion 84 are joined together such that they are removably connected together. As such, the first waveguide portion 82 and the second waveguide portion 84 can be taken apart to access the interior of the waveguide assembly 80, in the case where one or both of the portions need to be modified or repaired.

In an alternative embodiment, the first waveguide portion 82 and the second waveguide portion 84 can be fastened together in a permanent manner, wherein the two mating rims 110*a* and 110*b* are joined together via welding, for example. In such an embodiment, the first waveguide portion 82 and the second waveguide portion 84 are joined such that they cannot be separated without causing damage to the two waveguide portions 82 and 84.

The configuration of waveguide assembly 80 differs from the configuration of waveguide assemblies 10 and 40. Specifically, the waveguide assemblies 10 and 40 have waveguide components that are arranged one after the other in a linear sequence, whereas the waveguide assembly 80 has waveguide components 92, 94 and 96 that are not positioned one after the other. Instead, in waveguide assembly 80, the harmonic filter 94 is positioned above the transmit filter 96. As best shown in FIG. 15, in light of this arrangement, the interface 83 between the first portion 82 and the second portion 84 (which is created when the two mating rims 110*a* and 110*b* are joined together) is positioned along the y-z plane with respect to the coordinate system shown. As such, in the specific orientation shown, the first waveguide portion 82 and the second waveguide portion 84 are positioned in a side-by-side relationship and not in a top/bottom relationship as was the case with the waveguide assemblies 10 and 40.

Referring back to FIGS. 15, 16 and 17, positioned at one end of the waveguide assembly 80 is a connecting interface 86 that is suitable for allowing the waveguide assembly 80 to be connected to an external device. The connecting interface 86 is a separate component that is attached to one end of the waveguide assembly 40, and is not integrally formed with either the first waveguide portion 82 or the second waveguide portion 84. In addition, positioned at the same end of the waveguide assembly 80 as the connecting interface 86, is a port 87 for a co-axial adaptor. More specifically, the port 87 for the co-axial adaptor is positioned on the exterior surface 108 of the second waveguide portion 84, which can be best seen in FIG. 17.

Referring to FIGS. 18 through 21, the isolator 92 includes three waveguide arms 91*a*, 91*b* and 91*c*. The waveguide arm 91*a* leads to the harmonic filter 94, which in turn leads to the area where the connecting interface 86 is connected. The waveguide arm 91*b* leads to the transmit filter 96, which in turn leads to the port 87 for the co-axial adaptor. The port 87 for the co-axial adaptor is always connected to source. Finally, waveguide arm 91*c* is a termination arm for absorbing any microwave energy that travels into this arm. In this manner, the termination arm prevents any microwave energy that enters this arm from continued propagation. Region 98 shown in FIG. 17 is where waveguide arm 91*c* terminates, and where the microwave energy is absorbed. Given that waveguide assembly 80 is not intended to handle high powers, a terminator structure, such as terminator 50, is not necessary.

Spacing of Components

Traditionally, each individual waveguide component (such as the isolators, e-bends, monitoring couplers, harmonic filters and transmit filters, described above) would have had two connecting interfaces or flanges (such as connecting interfaces 24, 48 and/or 86) positioned on each of its input and output ends. In this manner, in order to form a waveguide assembly, a series of waveguide components would be connected together via their connecting interfaces.

In accordance with the present invention, multiple waveguide components are included within a waveguide assembly that is formed of only a first portion and a second portion. As such, the waveguide components are positioned (or cascaded) next to each other within the waveguide assemblies 10, 40 and 80, such that there are no flanges or connecting interfaces between the waveguide components.

However, the waveguide components within the waveguide assemblies 10, 40 and 80 are still separated from one another by a separation space that will be referred to herein as a "matching network". These matching networks are spaces included between the waveguide components in order to facilitate better phase matching between two adjacent waveguide components, and to reduce reflection losses or return losses in the waveguide assemblies.

With reference to the first and second waveguide portions 12 and 14 of the waveguide assembly 10 shown in FIGS. 4 and 6, positioned between the harmonic filter 18 and the transmit filter 20 is a matching network 21. Although not clearly identifiable from the pictures, there is also a matching network between the monitoring coupler 16 and the harmonic filter 18, as well as a matching network between the transmit filter 20 and the e-bend 22. The dimensions (height, width and depth) and positioning of these matching networks can be optimized in order to obtain a desired response for the overall waveguide assembly 10.

Likewise, with reference to the first and second portions 42 and 44 of the waveguide assembly 40 shown in FIGS. 12 through 14, positioned between the harmonic filter 54 and the transmit filter 56 is a matching network 58. Although not clearly identifiable from the pictures, there is also a matching network between the harmonic filter 54 and the isolator 52. The dimensions (height, width and depth) and positioning of this matching network can be optimized in order to obtain a desired response for the overall waveguide assembly 40.

With reference to the first and second portions 82 and 84 of the waveguide assembly 80 shown in FIGS. 18 through 21, positioned between the harmonic filter isolator 92 and the harmonic filter 94 is a matching network 97. This matching network 97 is positioned after waveguide arm 91*a* forms an H-bend. Although not clearly identifiable from the pictures, there is also a matching network between waveguide arm 91*b* of the isolator 92 and the transmit filter 96. The dimensions (height, width and depth) and positioning of these matching networks can be optimized in order to obtain a desired response for the overall waveguide assembly 80.

By changing the dimensions (which could involve changing one or more of the height, width and depth) of the matching networks located between two adjacent waveguide components, a desired performance characteristic for the waveguide assembly can be more closely achieved. For example, based on the dimensions of the matching networks, the unwanted resonance created by the space between two adjacent components (Low pass filter and High pass filter) of the finished waveguide assembly can be set such that it is above or below the pass band. In addition, the dimensions of the matching networks can be determined in order to obtain a desired return loss for the waveguide assembly. As such, each matching network between two waveguide components will be designed taking into consideration its two adjacent waveguide components, so as to get a desired performance response for the entire waveguide assembly. When selecting the dimensions of the matching networks, sufficient margins can be built in so as to be able to compensate for machining tolerances.

As such, during the design phase of the waveguide assembly, the shape and configuration of the waveguide components, as well as the dimensions and positioning of the matching networks can be modeled together in order to better predict the interaction of the waveguide components once the waveguide assembly is manufactured. More specifically, the size, shape and dimensions of the matching networks can be modeled and optimized, such that the desired interaction and response of the overall waveguide assembly can be predicted. In certain circumstances, the shapes and configurations (or the input/output impedance) of the waveguide components can also be adjusted prior to manufacturing, in order to improve the performance response of the waveguide assembly.

As such, a person designing a waveguide assembly in accordance with the present invention will be able to adjust (within a given range) how the different waveguide components and matching networks will interact in order to give the desired performance response to the finished waveguide assembly. This can significantly reduce the amount of tuning that needs to be performed on the finished waveguide assembly. In addition, it allows a designer to adjust the phase matching of the waveguide components within the waveguide assembly prior to manufacture. This differs from conventional waveguide assemblies, where the response of the overall waveguide assembly will not be known until all of the waveguide components are assembled together via their respective flanges.

Figure 22:
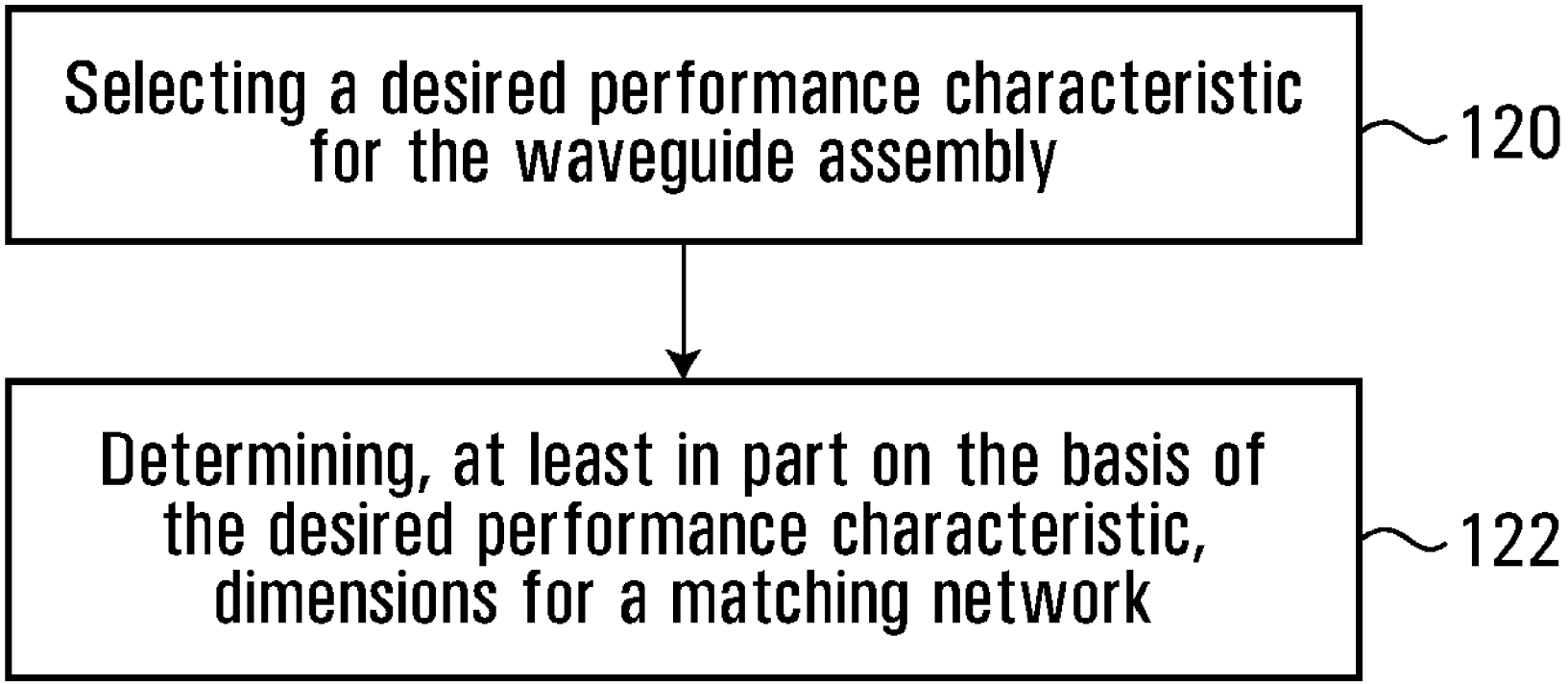
FIG. 22 shows a non-limiting flow diagram of a method for determining the dimensions of a matching network positioned between two waveguide components of a waveguide assembly in accordance with the present invention.

Shown in FIG. 22 is a non-limiting flow diagram of a method for determining the dimensions of a matching network, in accordance with the present invention. Firstly, at step 120, a desired performance characteristic for the waveguide assembly is selected. For example, it may be known that the finished waveguide assembly should have a return loss of between 20-23 dB. As such, in order to provide a sufficient margin to take into consideration machining tolerances, a user may select a desired return loss of 26 dB. At step 122, the method involves determining, at least in part on the basis of the desired performance characteristic, dimensions for a matching network between two waveguide components.

In accordance with a non-limiting embodiment, the dimensions (height, width, depth) of the matching networks required in order to provide the desired response characteristics for the finished waveguide assembly can be determined using finite element software packages or mode matching software packages, which are commonly available off the shelf. These software packages determine the appropriate dimensions of the matching networks on the basis of at least one of the desired performance characteristics, such as resonance, reflection losses, return losses and/or phase matching, among other possibilities.

For example, in accordance with a non-limiting example of implementation, in order for the software package to determine the optimized dimensions for the matching network based on the desired performance characteristic, initial dimensions for the matching network are input into the computer. These initial dimensions can be obtained theoretically (based on Bode-Fano criteria). These initial dimensions are entered into the modeling software along with the desired performance characteristic or goal functions of the final waveguide assembly (such as the desired return loss). The outputs provided by the computer program will be the optimum dimension (height, width, depth) of the matching network(s) in order to achieve the desired performance characteristics of the final waveguide assembly.

In this manner, a waveguide assembly having desired performance characteristics (such as a desired return loss) can be modeled and optimized prior to manufacture. In order to improve and fine-tune the performance of the waveguide assemblies, tuning screws can be included between the waveguide components to add another degree of freedom for matching the phase of the overall waveguide assemblies. In general, these tuning screws will be located at the center of each matching network where the length and the height may need small adjustments.

By including multiple waveguide components within a waveguide assembly that is formed of only a first portion and a second portion, the capability of tuning each component, once manufactured, is compromised. However, the waveguide components and the matching networks can be modeled and optimized as a complete waveguide assembly prior to manufacturing in order to get as close as possible to the desired performance for the overall waveguide assembly. As such, the requirement to tune the waveguide assembly once it has been manufactured is greatly reduced.

Once the optimized design of the complete waveguide assembly is ready, the waveguide assembly is machined with a very high precision to get the closest dimension possible to the simulated and optimized model. By using this new approach, the interaction of the components contained within the waveguide assembly is no longer an unknown parameter that has to be dealt with at latest stage of the testing process (which was typically the case with conventional waveguide assemblies).

In addition, it has been found that waveguide assemblies in accordance with the present invention have lower return losses than conventional waveguide assemblies that are created by assembling multiple waveguide components via flanges or connecting interfaces. In general, it has been found that the entire insertion loss is improved over conventional waveguide assemblies, by 0.05 dB for every flange/connecting interface that is removed from the waveguide assembly. In addition, due to the fact that the waveguide assemblies of the present invention have removed the flanges/connecting interfaces from between the waveguide components, the multiple waveguide components are provided in a more compact space. For example, the waveguide assemblies 10, 40 and 80 are able to provide multiple different waveguide components in a smaller space than was traditionally possible by using connecting interfaces. This is due to the fact that the space taken up by the matching networks located between the waveguide components is less than the standard space that is occupied by connecting interfaces positioned between individual waveguide components.

In addition, waveguide assemblies in accordance with the present invention that include multiple different waveguide components therein, will be lighter than an arrangement of the same number of separate waveguide components that are connected together via the connecting interfaces. As such, the waveguide assemblies of the present invention require less space and are lighter than existing waveguide assemblies having the same functionality.

Order of Components

In each of the waveguide assemblies 10, 40 and 80 described above, the waveguide components are positioned in a specific order. For example, with respect to waveguide assembly 10, the e-bend 22 is positioned next to the transmit filter 20, which is positioned next to the harmonic filter 18, which is positioned next to the monitoring coupler 16. It should, however, be appreciated that these waveguide components could be positioned in any order without departing from the spirit of the invention. More specifically, depending on the performance requirements of a particular waveguide assembly, the shape, configuration and order of the waveguide components can be changed.

Method of Manufacture

In accordance with the present invention, the first portions and second portions of the waveguide assemblies are manufactured separately as two distinct pieces. In a specific, non-limiting example, each of the first and second portions are manufactured via machining processes using manual and/or CNC machines.

In order to achieve good functionality of the waveguide assemblies, the first portion and the second portion (such as first portion 12 and second portion 14 of waveguide assembly 10) are manufactured with very tight tolerances. In general, the entirety of the first portion and the second portion are manufactured in accordance with the tolerances specified for the most sensitive component of the assembly, which are generally the filters. The machining tolerances are chosen based on the margins and sensitivity analysis carried out by the mode matching or finite element software packages. In accordance with a non-limiting embodiment, and depending on the operating frequency band, the tolerances can vary from ±0.003 at L-band frequency to ±0.0002 at Q-band frequency.

In an alternative, non-limiting example, the first portions and second portions of the waveguide assemblies are manufactured via a casting process. In this embodiment, a mold is made for each of the first and second portions, and molten metal is poured into the molds for creating each of the two portions.

The two portions (namely the first portion and the second portion) of the waveguide assemblies can be made of stainless steel, aluminum, brass, copper or invar, among other possibilities. All of these materials can be plated with gold or silver, or any other suitable platting material.

Although the present invention has been described in considerable detail with reference to certain preferred embodiments thereof, variations and refinements are possible without departing from the spirit of the invention. Therefore, the scope of the invention should be limited only by the appended claims and their equivalents.

What is claimed is:

1. A waveguide assembly for handling microwave signals, the waveguide assembly comprising:

a) a first waveguide portion defining:

i) a first portion of a first waveguide component; and ii) first portion of a second waveguide component;

wherein the first waveguide component and the second waveguide component each manipulate the microwave signals that pass therethrough;

b) a second waveguide portion defining:

i) a second portion of the first waveguide component; and ii) a second portion of the second waveguide component;

c) a matching network defining a space between the first waveguide component and the second waveguide component, wherein the dimensions of the matching network are based at least in part on a desired resonance for the waveguide assembly.

2. The waveguide assembly as defined in claim 1, wherein the first waveguide component and the second waveguide component are selected from at least one member from a group consisting essentially of a harmonic filter, a circulator, an isolator, a transmit filter, a coupling device, an e-bend, an h-bend, a power monitor, a coupling monitor and an arc guide.

3. The waveguide assembly as defined in claim 2, wherein the first waveguide portion includes a first mating surface and the second waveguide portion includes a second mating surface, the first waveguide portion and the second waveguide portion being connected together along the first and second mating surfaces.

4. The waveguide assembly as defined in claim 3, wherein the first waveguide portion and the second waveguide portion are connected together via mechanical fasteners.

5. The waveguide assembly as defined in claim 1, wherein the waveguide assembly is absent tuning components between the first waveguide component and the second waveguide component.

6. A method for creating a waveguide assembly for handling microwave signals, the method comprising:

a) manufacturing a first waveguide portion of the waveguide assembly, the first waveguide portion including an interior surface and an exterior surface, the interior surface of the first waveguide portion defining:

(1) a first portion of a first waveguide component;

(2) a first portion of a second waveguide component; and (3) first portion of a matching, network;

wherein the first waveguide component and the second waveguide component each manipulate the microwave signals that pass therethrough;

b) manufacturing a second waveguide portion of the waveguide assembly, the second waveguide portion including an interior surface and an exterior surface, the interior surface of the second waveguide portion defining:

(1) a second portion of the first waveguide component;

(2) a second portion of the second waveguide component; and (3) a second portion of the matching network; and c) connecting the first waveguide portion and the second waveguide portion together, such that, when connected, the interior surface of the first waveguide portion and the interior surface of the second waveguide portion together define a complete shape of at least the first waveguide component, the second waveguide component and the matching network, the matching network being between the first waveguide component and the second waveguide component and having dimensions based at least in part on a desired resonance for the waveguide assembly.

7. The method as defined in claim 6, wherein the first waveguide portion and the second waveguide portion are manufactured via machining.

8. The method as defined in claim 6, wherein the first waveguide portion and the second waveguide portion each include a respective mating surface, the method further comprising connecting the first waveguide portion and the second waveguide portion together by placing their respective mating surfaces together.

9. The method as defined in claim 8, further comprising connecting her the first waveguide portion and the second waveguide portion via mechanical fasteners.

10. The method as defined in claim 9, wherein the first waveguide component and the second waveguide component are at least one member selected from a group consisting essentially of a harmonic filter, a circulator, an isolator, a transmit fitter, a coupling device, an e-bend, an h-bend, a power monitor, a coupling monitor and an arc guide.

11. A method for creating a waveguide assembly including a first waveguide component and a second waveguide component, the method comprising:

a) determining, using computational simulation on a computing apparatus, dimensions of a space that defines a matching network between the first waveguide component and the second waveguide component, the first waveguide component and the second waveguide component each capable of manipulating microwave signals that pass therethrough, wherein the dimensions of the space are determined at least in part based on a desired resonance for the waveguide assembly; and b) manufacturing the waveguide assembly via a computer numerical control (CNC) machining operation, wherein the matching network between the first waveguide component and the second waveguide component is formed by a first portion and a second portion, wherein:

i) the first portion defines:

(1) a first portion of the first waveguide component;

(2) a first portion of the second waveguide component; and (3) a first portion of the matching network;

ii) the second portion defines:

(1) a second portion of the first waveguide component;

(2) a second portion of the second waveguide component; and (3) a second portion of the matching network.

12. The method for creating a waveguide assembly as defined in claim 11, further comprising tuning the waveguide assembly when the first portion and second portion have been joined together.

13. A waveguide assembly comprising:

a) a first waveguide portion including an interior surface and an exterior surface, the interior surface of the first waveguide portion defining:

(1) a first portion of a waveguide circulator;

(2) a first portion of a transmit filter; and (3) a first portion of a harmonic filter; and b) a second waveguide portion including an interior surface and an exterior surface, the interior surface of the second waveguide portion defining:

(1) a second portion of the waveguide circulator;

(2) a second portion of the transmit filter; and (3) a second portion of the harmonic filter;

wherein the first waveguide portion and the second waveguide portion are adapted to be coupled together to form the waveguide assembly such that, when coupled together, the waveguide assembly includes at least the waveguide circulator, the transmit filter and the harmonic filter.

14. The waveguide assembly as defined in claim 13, wherein the first waveguide portion includes a first mating surface and the second waveguide portion includes a second mating surface, the first waveguide portion and the second waveguide portion being coupled together along the first and second mating surfaces.

15. The waveguide assembly as defined in claim 14, wherein the first waveguide portion and the second waveguide portion are coupled together via mechanical fasteners.

16. The waveguide assembly as defined in claim 13, further comprising a matching network positioned between the first waveguide component and the second waveguide component, the matching network being adapted to improve phase matching between the first waveguide component and the second waveguide component.

17. The waveguide assembly as defined in claim 16, wherein dimensions of the matching network are determined based on at least one of a desired passband, resonance, and reflection loss of the waveguide assembly.

18. The waveguide assembly as defined in claim 13, wherein the first waveguide portion and the second waveguide portion are manufactured via at least one machining process.

19. The waveguide assembly as defined in claim 13, wherein the first waveguide portion and the second waveguide portion are manufactured via a casting operation.

20. The waveguide assembly as defined in claim 13, wherein the waveguide assembly is absent tuning components between the first waveguide component and the second waveguide component.

* * * * *